US007246859B2

(12) United States Patent
Igarashi et al.

(10) Patent No.: US 7,246,859 B2
(45) Date of Patent: Jul. 24, 2007

(54) CHAIR

(75) Inventors: Ryo Igarashi, Yokohama (JP); Naoki Numa, Yokohama (JP); Ken Nakayama, Yokohama (JP); Hiroshi Masunaga, Yokohama (JP)

(73) Assignee: Okamura Corporation (JP)

( * ) Notice: Subject to any disclaimer, the term of this patent is extended or adjusted under 35 U.S.C. 154(b) by 0 days.

(21) Appl. No.: 11/456,114

(22) Filed: Jul. 7, 2006

(65) Prior Publication Data

US 2006/0244295 A1 Nov. 2, 2006

Related U.S. Application Data

(62) Division of application No. 10/621,725, filed on Jul. 17, 2003, now Pat. No. 7,097,249.

(30) Foreign Application Priority Data

| | | |
|---|---|---|
| Jul. 23, 2002 | (JP) | 2002-213458 |
| Jul. 23, 2002 | (JP) | 2002-213459 |
| Jul. 23, 2002 | (JP) | 2002-213810 |
| Sep. 26, 2002 | (JP) | 2002-281550 |
| Oct. 1, 2002 | (JP) | 2002-288194 |

(51) Int. Cl.
*A47C 7/54* (2006.01)

(52) U.S. Cl. ..... 297/411.36; 297/411.37

(58) Field of Classification Search ..... 297/411.36, 297/411.37

See application file for complete search history.

(56) References Cited

U.S. PATENT DOCUMENTS

| | | | | |
|---|---|---|---|---|
| 4,630,866 A | | 12/1986 | McFarlane | |
| 5,314,237 A | | 5/1994 | Koepke et al. | |
| 5,368,365 A | * | 11/1994 | Feldberg | 297/411.36 |
| 5,382,079 A | * | 1/1995 | Wilson et al. | 297/411.36 |
| 5,620,233 A | * | 4/1997 | Corwin | 297/411.36 |
| 5,641,203 A | * | 6/1997 | Van De Riet et al. | 297/411.37 |
| 5,647,638 A | * | 7/1997 | Ritt et al. | 297/411.36 |
| 5,664,842 A | * | 9/1997 | Tseng | 297/411.36 |
| 5,667,277 A | * | 9/1997 | Van De Riet | 297/411.36 |
| 5,725,276 A | | 3/1998 | Giant | |
| 5,765,914 A | | 6/1998 | Britain et al. | |
| 5,853,223 A | * | 12/1998 | Ritt et al. | 297/411.36 |
| 5,895,095 A | * | 4/1999 | Chen | 297/411.36 |
| 5,931,537 A | * | 8/1999 | Gollin et al. | 297/411.36 |
| 5,964,503 A | | 10/1999 | Inoue | |
| 5,975,634 A | | 11/1999 | Knoblock | |
| 6,039,397 A | | 3/2000 | Giant | |
| 6,050,634 A | * | 4/2000 | Yamagishi et al. | 297/411.36 X |
| 6,062,647 A | * | 5/2000 | Mei | 297/411.36 |
| 6,209,961 B1 | * | 4/2001 | Chen | 297/411.36 |

(Continued)

FOREIGN PATENT DOCUMENTS

| | | |
|---|---|---|
| JP | 10179328 | 6/1988 |

(Continued)

*Primary Examiner*—Rodney B. White

(57) ABSTRACT

A chair has a backrest and a pair of armrests. A pair of support struts for supporting the backrest is connected to a shaft of a base under a seat. The armrest is supported by an arm post. An operating lever is mounted on the upper front end of the arm post. When the backrest is tilted, it is held at a desired angle by pressing up the operating lever.

1 Claim, 21 Drawing Sheets

U.S. PATENT DOCUMENTS

| | | | | |
|---|---|---|---|---|
| 6,296,312 | B1 * | 10/2001 | Congleton et al. | 297/411.35 |
| 6,315,362 | B1 * | 11/2001 | Chuang | 297/411.36 |
| 6,336,680 | B1 * | 1/2002 | Lee | 297/411.36 |
| 6,343,840 | B1 * | 2/2002 | Chuang | 297/411.36 |
| 6,398,309 | B1 * | 6/2002 | Chen | 297/411.36 |
| 6,419,323 | B1 * | 7/2002 | Chu et al. | 297/411.36 |
| 6,460,932 | B1 * | 10/2002 | Kopish et al. | 297/411.36 |
| 6,523,898 | B1 | 2/2003 | Ball et al. | |
| 6,540,300 | B2 * | 4/2003 | Piretti | 297/411.35 |
| 6,568,760 | B2 | 5/2003 | Davis et al. | |
| 6,585,322 | B1 * | 7/2003 | Lai | 297/411.36 |
| 6,609,755 | B2 | 8/2003 | Koepke et al. | |
| 6,619,746 | B2 * | 9/2003 | Roslund et al. | 297/411.36 |
| 6,669,292 | B2 | 12/2003 | Koepke et al. | |
| 6,773,072 | B2 * | 8/2004 | Phillips et al. | 297/411.35 |
| 7,097,249 | B2 * | 8/2006 | Igarashi et al. | 297/323 |
| 7,097,254 | B2 * | 8/2006 | Hobb et al. | 297/411.36 |
| 2002/0113475 | A1 | 8/2002 | Ehr et al. | |
| 2003/0001420 | A1 | 1/2003 | Koepke et al. | |
| 2003/0178882 | A1 * | 9/2003 | Schmitz et al. | 297/411.36 |
| 2004/0004385 | A1 * | 1/2004 | Lee | 297/411.36 |

FOREIGN PATENT DOCUMENTS

| | | |
|---|---|---|
| JP | 2124063 | 5/1990 |
| JP | 10165255 | 6/1998 |

* cited by examiner

CHAIR

This application is a division of application Ser. No. 10/621,725 filed Jul. 17, 2003 now U.S. Pat. No. 7,097,249 B2.

BACKGROUND OF THE INVENTION

The present invention relates to a chair which comprises an operating lever, a cable and a tilting device for locking a seat or a backrest at an optional tilting angle and releasing it.

A conventional chair in which a backrest is locked at an optional stepwise angle usually has a tilting device in which a pin which projects on an operating lever rotatably mounted to a seat or an engagement lever related therewith is engaged with or disengaged from teeth formed on the outer circumferential surface of a sector gear which turns together with the backrest.

However, in the chair, the operating lever is located on the rear side. Especially when an armrest is provided, it is difficult to operate the operating lever since an arm of a person must be turned outward of the armrest.

In a home chair, under a seat, there are provided operating levers for adjusting a tilting angle of the backrest or the seat, height and promoting force. However, it is hard to operate the operating levers while a person sits in the seat. Especially, one has to adjust a tilting angle of the backrest, while the backrest is inclined downward with the person's back. Thus, as the tilting angle becomes larger, the operating lever goes away from the shoulder of the person thereby making the operation harder.

SUMMARY OF THE INVENTION

In view of the foregoing disadvantages, it is an object of the invention to provide a chair in which a tilting angle of a backrest or a seat can be easily adjusted while a person sits in the seat without the positional relationship between the person and the operating lever being significantly changed even if the person is inclined together with the backrest of the chair.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENTS

Figure 1:
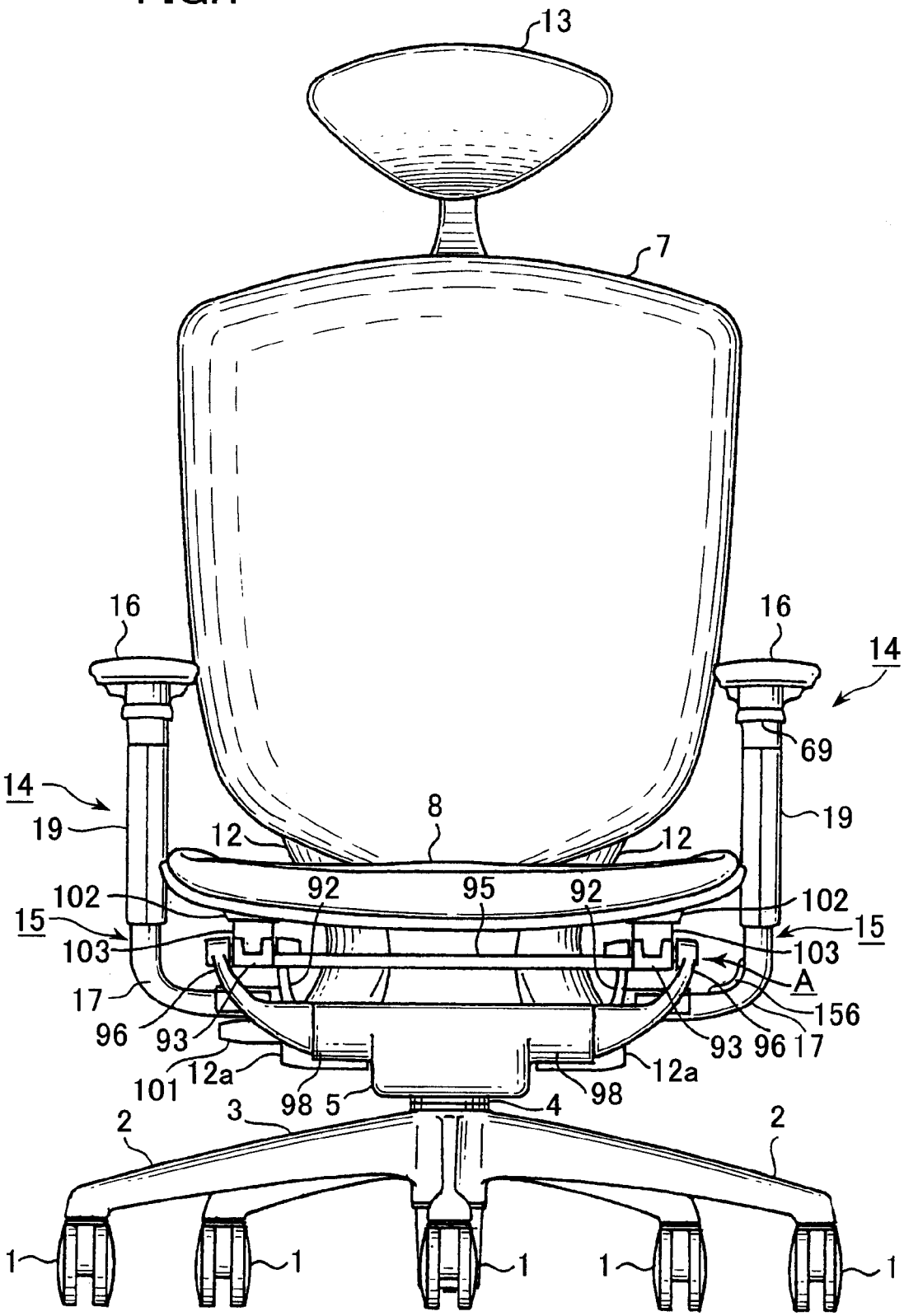
FIG. 1 is a front elevational view of a chair according to the present invention.
Figure 2:
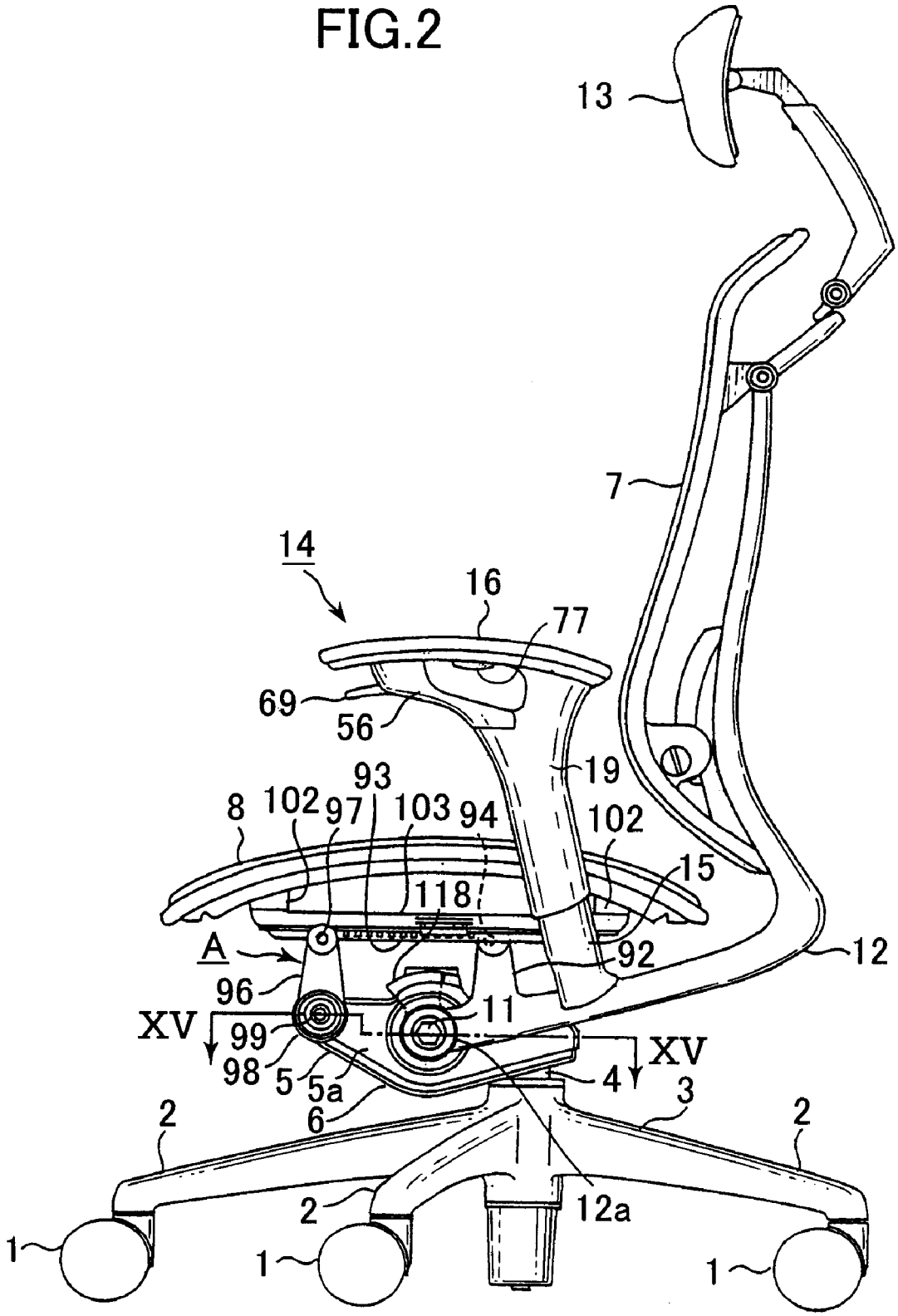
FIG. 2 is a side elevational view thereof.

FIG. 1 is a front elevational view of a chair according to the present invention, and FIG. 2 is a side elevational view of the same. The chair has a leg 3 having five feet 2 radially. A telescopic column 4 which has a gas spring (not shown) stands on the center of the leg 3, and the rear end of a base 5 is fixed to the upper end of the column 4.

The base 4 opens at the bottom and is formed as a hollow box, and the bottom is covered with a detachable cover 6.

In the base 5, there are force promoting return means for returning a backrest 7 and a seat 8 in FIG. 13 and switching means for promoting force in FIG. 15, which will be described later.

In the middle of the base 5, a hexagonal shaft 11 penetrates in a transverse direction so as to turn on its axis.

The ends of the shaft 11 which projects from side walls 5*a*,5*a* of the base 5 are fixedly covered with tubular portions 12*a*,12*a* of a pair of L-sectioned backrest support rods 12,12 for supporting a backrest 7, such that the backrest 7 and the backrest support rods 12,12 can be inclined downward and rearward around the shaft 11 together with the shaft 11.

The numeral 13 denotes a headrest at the upper end of the backrest 7, and 14 denotes an armrest which stands in the middle of the lower portion of the backrest support rod 12.

The armrest 14 comprises an arm post 15 slightly inclined upward on the backrest support rod 12; an armrest support rod 22 engaged with the rod 12 to move up and down, and an arm pad 16 mounted at the upper end of the rod 12 substantially in a horizontal direction. The arm pad 16 can be adjusted in height and width position by a height adjusting mechanism and a horizontal position adjusting mechanism which will be described later.

As shown in FIGS. 3 to 9 for describing the left-side armrest, the arm post 15 is made of an ellipse-sectioned metal pipe, and the lower end of the arm post 15 is engaged with the upper end of an L-shaped tubular connecting rod 17 connected to the outer surface of the backrest support rod 12 so that it may be fixed by a screw 18.

The outer circumferential surface except the lower end is covered with a post cover 19 which can be separated into an inner cover 19*a* and an outer cover 19*b* made of synthetic resin. The upper portion of the post cover 19 is gradually wider and the upper end of the rear portion is engaged on the lower surface of the rear end of the arm pad 16.

The height adjusting mechanism for the arm pad 16 is disposed in the arm post 15.

Figure 8:
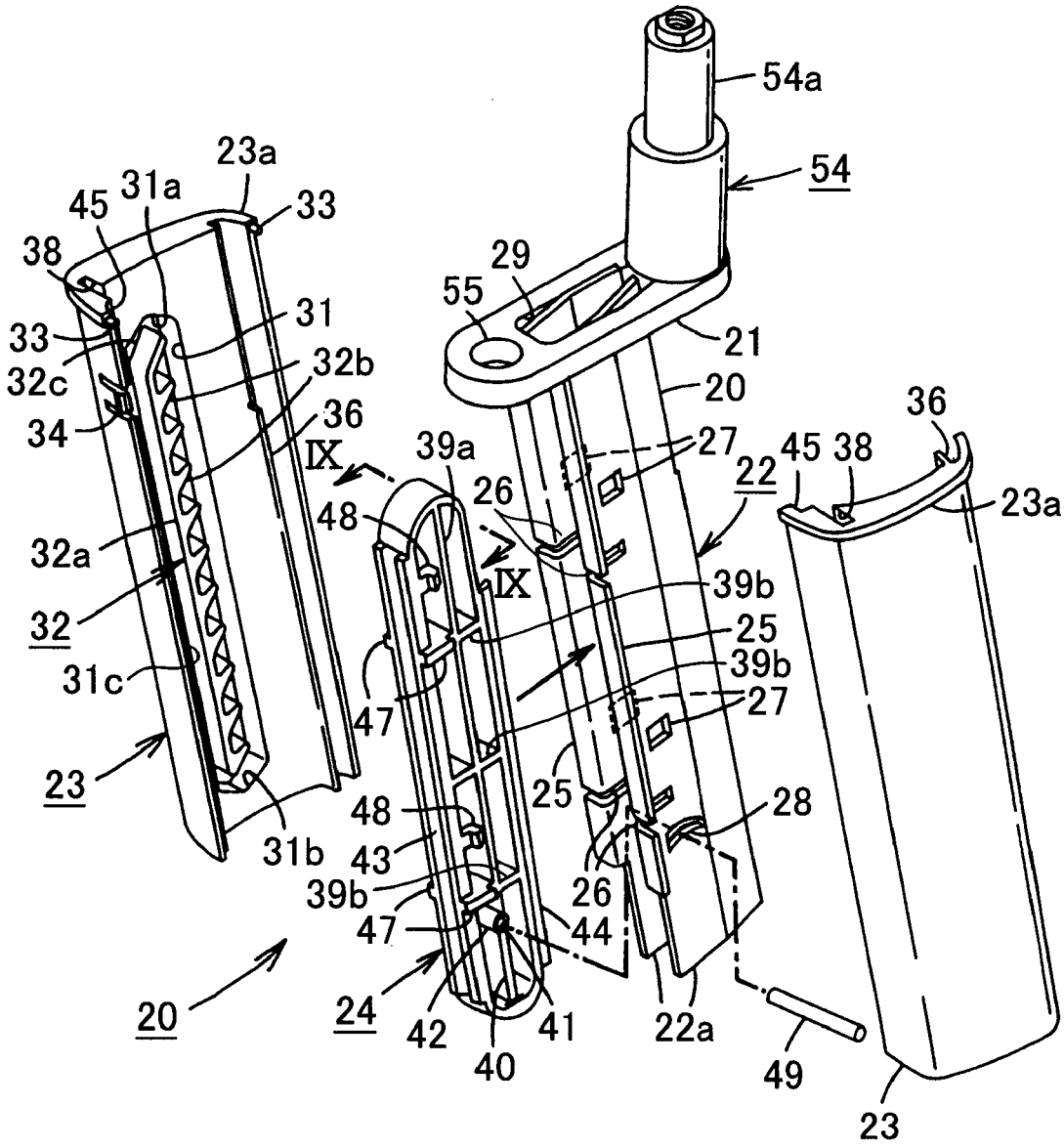
FIG. 8 is an exploded perspective view of a height adjusting mechanism.

As shown in FIG. 8, the height adjusting mechanism 21 comprises a metal armrest support rod 22 which has a horizontal armrest support plate 21 at the upper end; a pair of height-adjusting synthetic resin members 23 which surrounds the support rod 22 to enable the rod 22 to slide up and down; and a synthetic support member 24 which is engaged in the armrest support rod 22.

On the front edges of side plates 22*a* of the armrest support rod 22, outward support portions 25,25 are vertically formed and engagement slits 26 are formed in the support portions 25 and the side plates 22*a*.

Rectangular engagement openings 27,27 are formed slightly above the upper and lower engagement grooves 26,26 of the side plates 22*a*, and arc-like guide bores 28 are formed in the middle of a lower portion of the side plates 22*a*. A rectangular opening 29 is formed in the middle of the armrest support plate 21, and the upper end of the armrest support rod 22 is obliquely engaged and welded in the rectangular opening 29. The rear upper end of the armrest support rod 22 is cut out to make a notch 30 through which a cable (described later) passes.

A vertical groove 31 is formed in each of the height-adjusting member 23, and tilted upper and lower end faces 31*a*,31*b* are formed in the groove 31. In the groove 31, a stopper member 32 is provided and has a vertical base 32 which has a plurality of oblique engagement portions 32*b* on its rear surface to form an annular guide path 31*c* in which a pin 49 (described later) moves.

Figure 12:
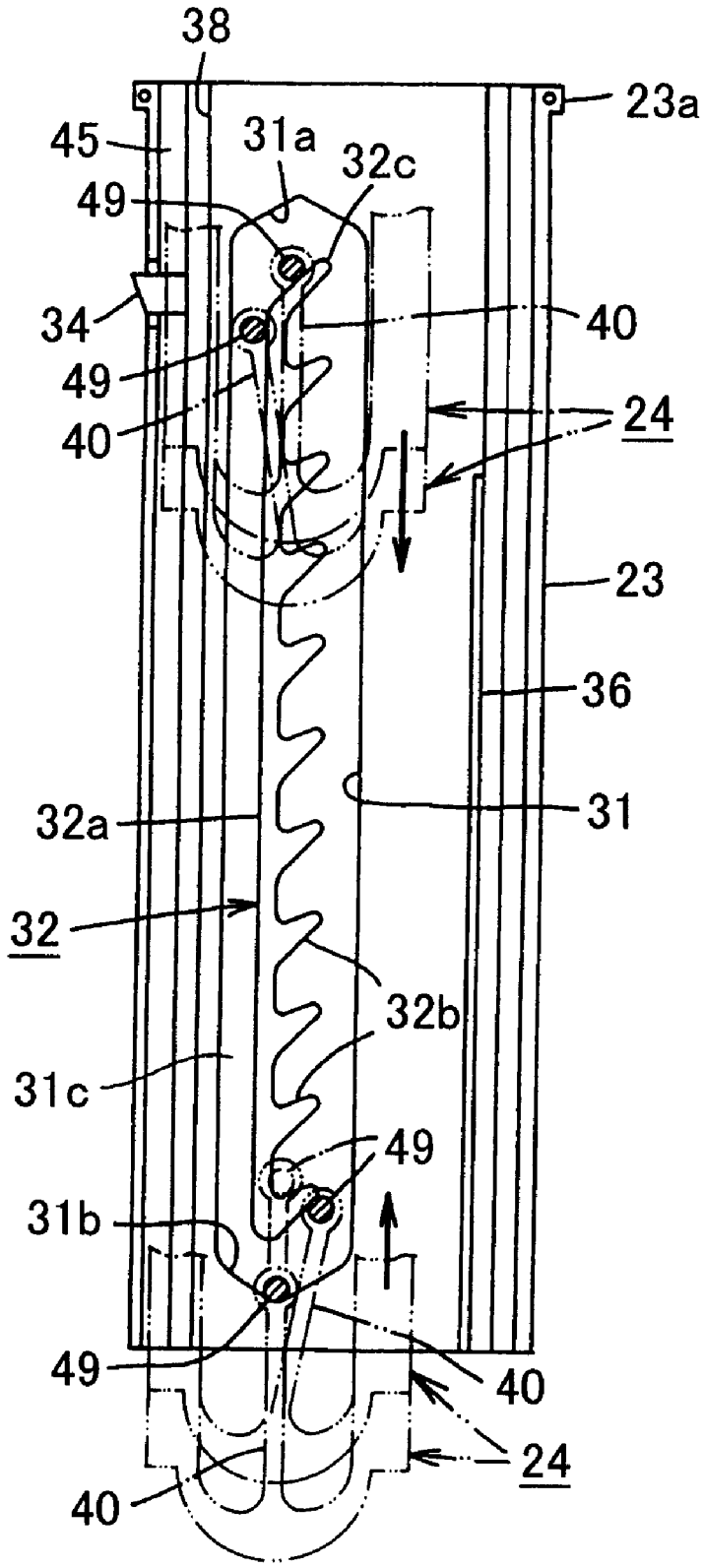
FIG. 12 is a side elevational view of a height adjusting member of the height adjusting mechanism.

In FIG. 12, the lower end of the base 32*a* is formed like an arcuate surface and disposed slightly before a V-shaped bottom of a lower inclined surface 31*b* of the groove 31. A guide portion 32*c* is formed at the upper end of the base 32.

Figure 3:
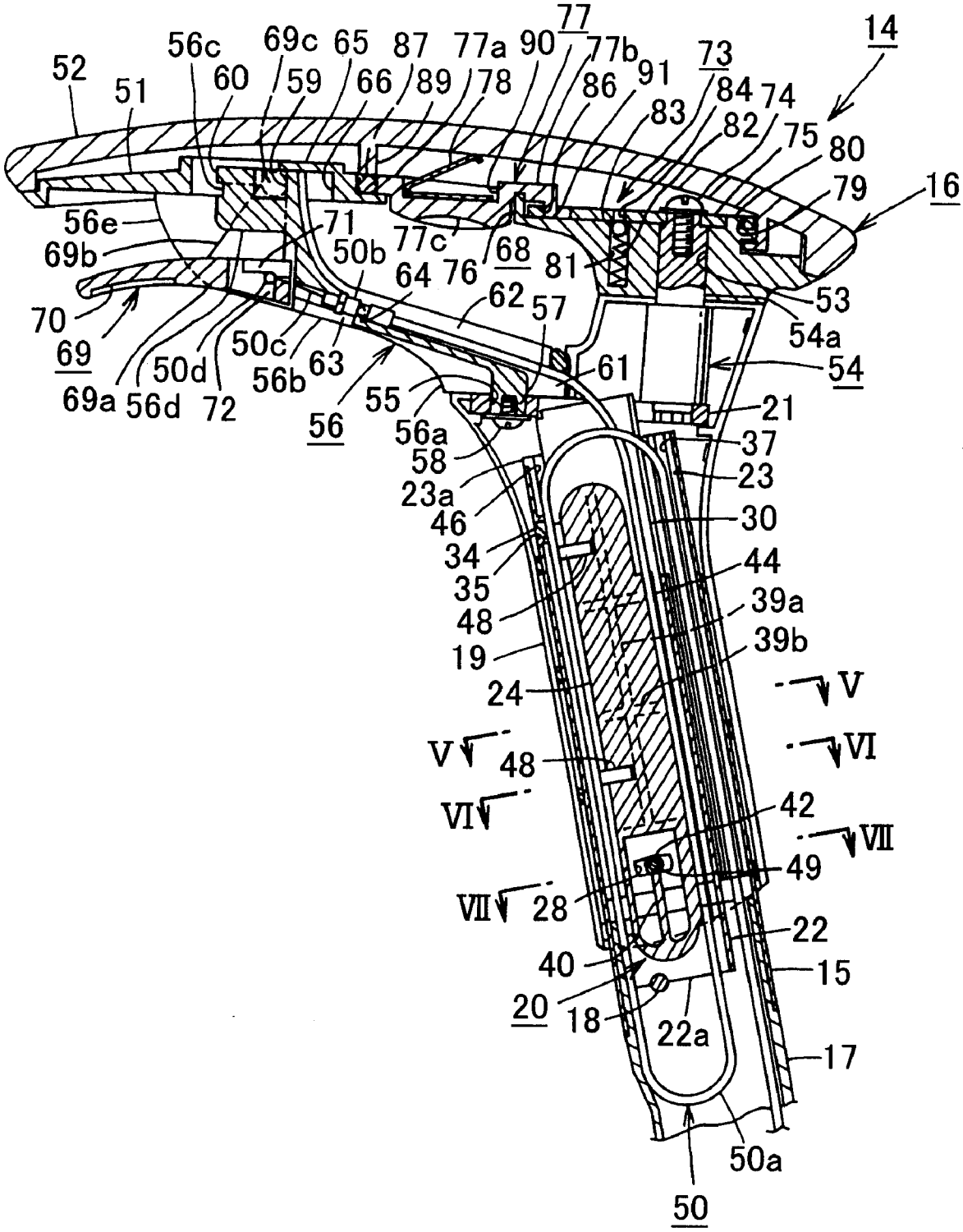
FIG. 3 is a central vertical sectional side view of an armrest.

A pair of projections 33 of the upper ends of inner height-adjusting members 23 is engaged in recesses (not shown) of the upper ends of outer height-adjusting members 23. Thereafter, a pair of height-adjusting members 23 is put into the arm post 15, and as shown in FIG. 3, outer flanges 23*a* at the upper ends of the height-adjusting members 23 are engaged on upper end openings of the arm posts 15. An elastic engagement portion 34 formed at the upper end of the height-adjusting member 23 is elastically engaged in an engagement bore 35 of the upper end of the arm post 15 so that the height-adjusting member 23 may be prevented from coming out of the arm post 15.

Figure 5:
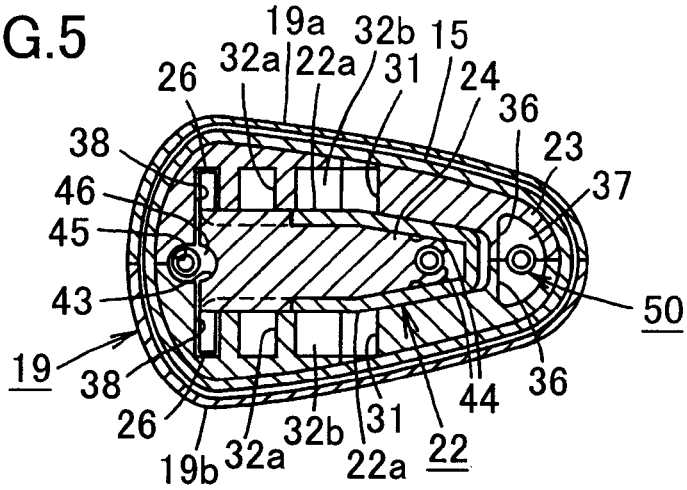
FIG. 5 is a horizontal sectional top plan view taken along the line V-V in FIG. 3.
Figure 6:
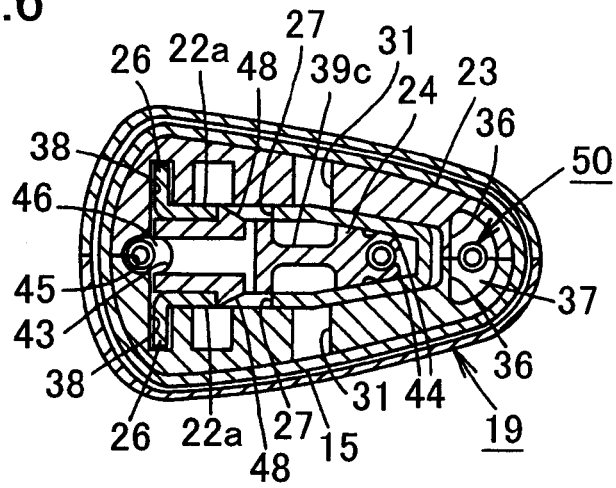
FIG. 6 is a horizontal sectional top plan view taken along the line VI-VI in FIG. 3.
Figure 7:
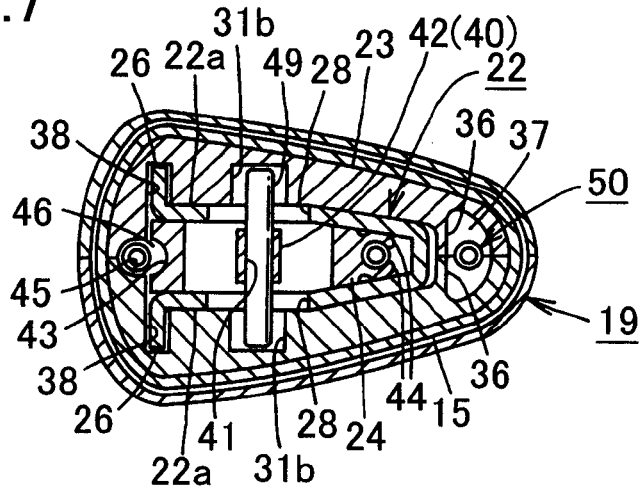
FIG. 7 is horizontal sectional plan view taken along the line VII-VII in FIG. 3.

When the height-adjusting members 23 are engaged in the arm post 15, ribs 36,36 are contacted to each other to form a bore 37 through which a cable 50 (mentioned later) passes as shown in FIGS. 5 to 7.

The armrest support rod 22 is inserted in the height-adjusting member 23 by slidably engaging the support portion 25 of the side plate 22*a* into a guide groove 38 of the height-adjusting member 23 as shown in FIGS. 5 to 7.

Figure 9:
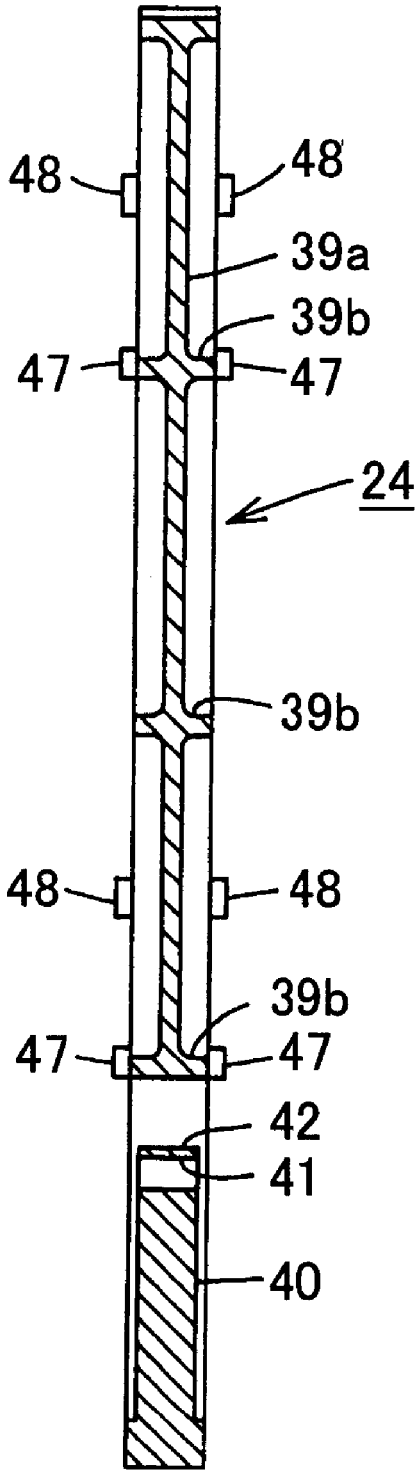
FIG. 9 is a vertical sectional rear view taken along the line IX-IX in FIG. 8.

As shown in FIGS. 8 and 9, the support member 24 is an oval shorter in height and depth than the support rod 22, and has a vertical rib 39*a*; a plurality of horizontal ribs 39*b* and a rib 39 as shown in FIG. 6 for connecting the ribs 39*a*,39*b* to the middle of the inner surface of the support member 24 integrally molded for reinforcement.

In a lower end space of the support member 24, an elastic support 40 which stands on the lower end is provided to achieve elastic deformation in a back-and-forth direction at the lower end. The upper end is integrally molded with a tubular axial support 42 which has an axial bore 41.

On the front surface of the support member 24, a vertical concave groove 43 is formed approximately over its height, and on the rear surface, arc-sectional holding portions 44, 44 are provided from the lower end to a portion closer to the upper end. Between the holding portions 44,44, a cable 50 described later is held as shown in FIGS. 5 to 7.

When the support member 24 secured to the armrest support rod 22 is disposed in the arm post 15, the cable 50 described later is put in the bore loosely.

In FIG. 8, at the same height as the upper and lower ribs 39*b*, projections 47 are provided from the front end of the support member 24 to the middle, and elastically deformable engagement claws 48 are provided on the side surfaces of the support member 24.

When the support member 24 is engaged with the armrest support rod 22, the projections 47 and the engagement claws 48 are engaged in the engagement groove 26 and the engagement bore 27 thereby preventing the support member 24 from moving vertically and horizontally.

After the support member 24 is mounted to the armrest support rod 22, a pin 49 held in an axial bore 41 of an axis support portion 42 of an elastic support 40 is projected from the side plates 22*a* through the guide bore 28 of the side plates 22*a* of the armrest support rod 22 in FIG. 7.

As shown in FIGS. 6 and 12, projecting ends of the pin 49 are supported by the V-shaped bottom of the lower inclined surface 31*b* in the groove 31 of the height-adjusting member 23, and the pin 49 faces the base of the lower inclined surface of the lowest engagement portion 32*b*.

As shown in FIGS. 3 to 7, the cable 50 is connected to an operating lever 69 at the upper end, and to an inclining device (described in detail later) of the armrest support rod 12. In the arm post 15, a flexible outer tube 50*a* of the cable 50 has a downward straight portion in the holding portion 44 at the rear end of the support member 24; a U-shaped portion at the lower end of the support member 24; an upward portion inserted in the bore 46 between the front surface of the support member 24 and the height-adjusting member 23; a U-shaped portion at the upper portion of the support member 24 between the side plates 22*a* of the armrest support rod 22; and a downward straight portion which passes into the bore 37 at the rear end of the height-adjusting member 23 through the cut-out portion 30 at the upper end of the armrest support rod 22 to loosely form a loop in a vertical direction.

The arm pad 16 comprises a synthetic resin armrest pad 52 screwed on a rectangular armrest base plate 51 made of Al alloy, the pad 52 being slightly larger than the base plate 51. A vertical shaft 54 is welded to the rear end of the armrest support plate 21 at the upper end of the armrest support rod 22. A smaller-diameter shaft 54*a* of the shaft 54 is engaged in a bore 53 of the armrest base plate 51, so that the rear end of the arm pad 16 is rotatably mounted in a horizontal direction by the armrest support rod 22.

The front portion of the arm pad 16 is supported by a support arm 56 engaged in a support bore 55 of the armrest support plate 21 rotatably in a horizontal direction as below.

Figure 10:
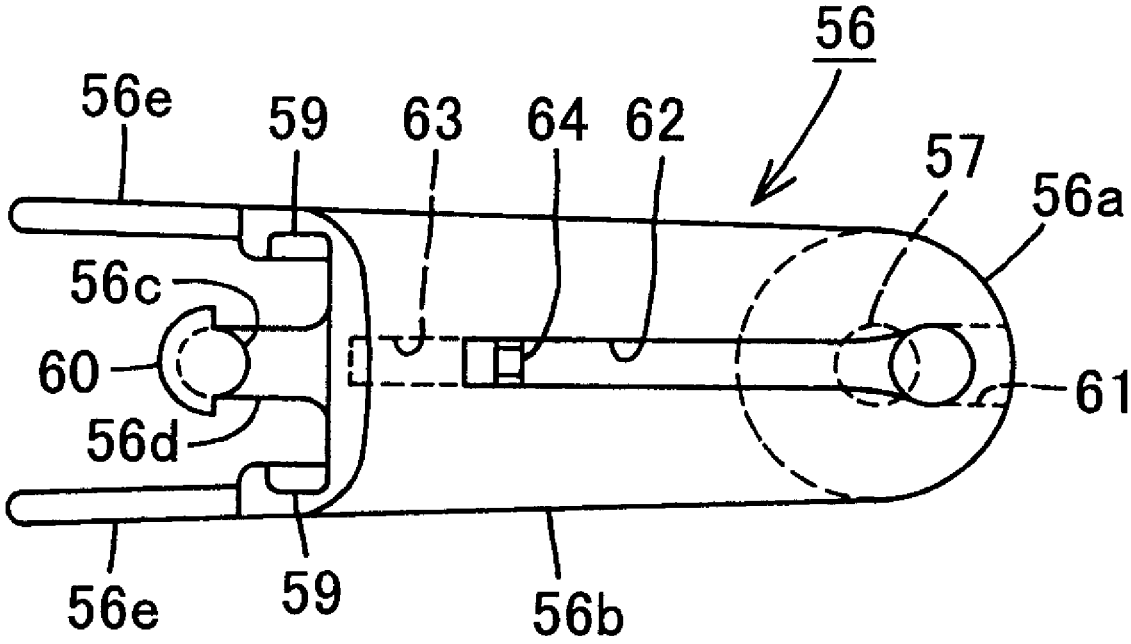
FIG. 10 is a top plan view of a support arm.

As shown in FIGS. 3 and 10, the support arm 56 comprises a circular base 56*a* which can be placed on the armrest support plate 21; an arm body 56*b* which extends forward and upward gradually from the base 56*a*; an auxiliary arm 56*d* which extends forward and has a vertical short axial portion 56*c*; and a side plate 56*e* which is in sliding contact with the lower surface of the front portion of the armrest base plate 51. A shaft 57 is projected in the middle of the lower surface of the base 56*a* and engaged rotatably in the bore 55 of the armrest support plate 21. Mounting of a screw 28 allows the support arm 56 to turn around the bore 55 laterally. A groove 59 is formed on the side plate 56*c*, and the upper end of an operating lever 69 described later is supported in the groove 59. A sliding portion 60 is projected on the axial portion 56*c* of the auxiliary arm 56*d*.

Behind the base 56*a* and over the arm body 56*b*, an insertion bore 61 and an insertion groove 62 for the cable 50 are formed to communicate with each other. Under the front end of the arm body 56*b*, an insertion opening 63 is formed to have a thread 50*b* at the end of the cable 50 and the end of a wire 50*c* which extends from the outer tube 50*a*.

The front portion of the cable 50 is placed in the insertion bore 61 and the insertion groove 62, and the thread 50*b* and the wire 50*c* are placed in the insertion opening 63, so that an engagement axial portion at the upper end of the wire 50*c* is projected from the arm body 56*b*. The end of the cable 50 is inserted into a grip 64 in the groove 62 and the opening 63 and fastened by the thread 50*b*.

Figure 11:
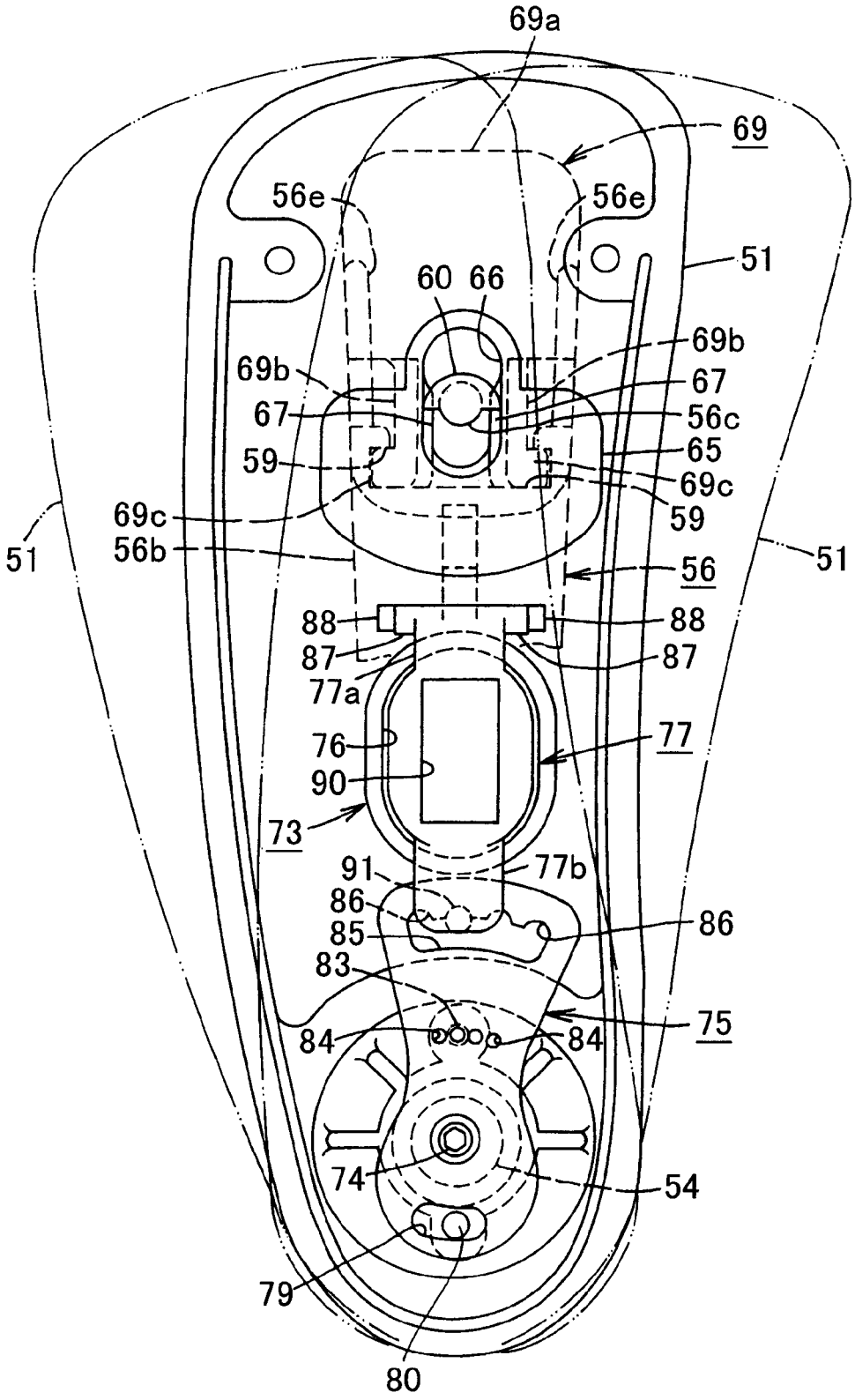
FIG. 11 is a top plan view of an armrest in which an arm pad is removed.

As stated above, the support shaft 57 at the lower end of the support arm 56 is rotatably mounted in the bore 55 of the armrest support plate 21. Thereafter, as shown in FIG. 11, the axial portion 56*c* is put in an elongate bore 66 of a lobe 65 in the front of the armrest base 51. On a pair of engagement step-like portions 67,67 a mutual distance of which is larger than a diameter of the axial portion 56*c*, the slider 60 is contacted to slide longitudinally so that the support arm 56 may turn laterally while the arm pad 16 is prevented from moving upward.

The upper end face of the arm body 56*b* is engaged on the lower surface of an upward lobe 65 to support the front portion of the arm pad 16. After the support arm 56 is mounted, under the arm pad 16, an opening 68 through which a hand can be put is surrounded by the arm body 56*b*, a post cover 19 and the armrest base 51.

The operating lever 69 for operating the cable 50 is secured at the front end of the support arm 56. The operating lever 69 comprises a lever body 69 having an arcuate recess 70 in which a finger is engaged; and a pair of support portions 69*b* insertable between the auxiliary arm 56*d* of the support arm 56 and the side plate 56*e*. As shown in FIGS. 3 and 11, a short shaft 69*c* which is insertable in the support groove 59 of the support arm 56 is projected at the upper end of the support portion 69*b*.

On the rear portion of the lever body 69*a*, there is a slit 71 in which the wire 50*c* at the end of the cable 50 and engagement shaft 50*d* are inserted, and there is formed a groove 72 for holding the engagement axial portion 50*d*.

To mount the operating lever 69 to the support arm 56, before securing the arm pad 16, the axial portion 50*d* of the cable 50 is inserted in the groove 72 through the slit 71 and mounted by a corner of the upper end thereof. Thereafter, the axial portions 69*c* at the upper ends of the support portions 69*b* are engaged in the support grooves 59 of the support arm 56.

The arm pad 16 is mounted, and as shown in FIGS. 3 and 10, the lower surface of the lobe 65 of the armrest base plate 51 contacts or draws closer to the upper end of the axial portion 69*c*. Thus, the axial portion 69*c* is prevented from leaving the groove 59, and the operating lever 69 can turn upward around the axial portion 69*c*, so that the wire 50*c* of the cable 50 is pulled. Furthermore, the operating lever 69 is always urged downward by tension force that acts on the wire 50*c* of the cable 50. Downward turning of the operating lever 69 is inhibited by engaging the rear end face thereof with the front end face of the arm body 56*b*.

The upper portion of the support portions 69*b* of the operating lever 69 may be rotatably mounted to the auxiliary arm 56*d* of the support arm 56 with a lateral pin thereby omitting the groove 59 of the support arm 56 and the axial portion 69*c* of the support portion 69*b*.

As shown in FIGS. 3 and 11, a horizontal position adjusting mechanism 73 is disposed on the rear portion of the armrest base plate 51, and comprises, on the upper end of the support shaft 54 of the armrest support rod 22, a position adjusting plate 75 fixed by a screw not to turn horizontally; an operating button 77 which is engaged in an elliptical guide bore 76 of the armrest base plate 51 to stop and allow turning of the arm pad 16 by engagement and disengagement with the position adjusting plate 75; and a leaf spring 78 for urging the button 77 downward anytime.

An elongate bore 79 which is an arc around a screw 74 is formed in the rear portion of the position adjusting plate 75, and a stopper pin is included in the elongate bore 79, so that the armrest can turn horizontally until the pin 80 contacts the right or left end of the bore 79. A blind bore 81 is formed before the bore 53 of the armrest base plate 51, in which a compression spring 82 and a ball 83 pressed upward thereby are disposed.

Four through bores 84 are formed in the middle of the position adjusting plate 75 and arranged as an arc of a circle around the shaft 54, and the ball 83 is selectively engaged in the bore 84. The blind bore 81, the compression spring 82, the ball 83 and the through-bores 84 may be omitted.

In the front portion of the position adjusting plate 75, an arcuate bore 85 is formed on a circle around the shaft 54. On the inner front surface, four engagement recesses 86 are formed such that the centers of the recess 84, the bore 84 and the shaft 54 are arranged on the straight. On the front and rear ends of the operating button 77, support portions 77*a*,77*b* are projected in a longitudinal direction to contact the upper surface of the armrest base plate 51, and a pair of axial portions 87 is projected on the front end of the front support portion 77*a*.

Both the axial portions 87 are rotatably put between a pair of holding portions 88 projected on the upper surface of the armrest base plate 51, and the lower end of a pressing portion 89 projected on the lower surface of the armrest pad 52 contacts or draws closer to the upper surface of the front portion of the support portion 88*a*, so that the operating button 77 can turn vertically around the axial portion 87 in the guide bore 76. Instead of the axial portion 87 held by a pair of holding portions 88, a pair of U-shaped bearing portions may be projected on the armrest base plate 51 so that the axial portion 87 is rotatably engaged in the bearing.

The leaf spring 78 has a "<"-shaped section, and the lower portion thereof is received in a rectangular groove on the operating button 77. The upper portion of the spring 78 is pressed by the lower surface of the armrest pad 52.

An engagement shaft 91 is projected downward in the middle of the rear end of the rear support portion 77*b*, and can be selectively engaged in any one of the engagement grooves 86. The lower end of the operating button 77 is slightly projected in an opening 68 between the arm pad 16 and the support arm 56 to turn upward. In the middle of the lower surface of the operating button 77, a recess 77*c* for receiving a finger is formed.

In the above embodiment of the armrest device, the height of the arm pad 16 can be adjusted as below:

As shown schematically in FIG. 12, when the height of the arm pad 16 is placed in a lower-limit position, the right and left ends of the pin 49 inserted in the upper end of the elastic support portion 40 of the support member 24 are received in the V-shaped lowest surface of the tilting surface 31*b* of the groove 31 of the height adjusting member 23 thereby preventing further lowering.

The whole armrest 14 is elevated, and both the ends of the pin 49 are moved rearward and upward along the lower surface of the first step engagement portion 32*b* of the stopper member 32, so that the elastic support portion 40 is elastically deformed rearward to return to the original vertical position as shown by a two-dotted line when the pin 49 comes over the end of the engagement portion 32*b*.

Thus, both the ends of the pin 49 are elastically engaged and received on the upper surface of the first-stage engagement portion 32*b*, so that the height of the arm pad 16 increases by the distance between the lower end of the groove 31 and the first-stage engagement portion 32*b* and the pin 49 is held at the position.

Figure 4:
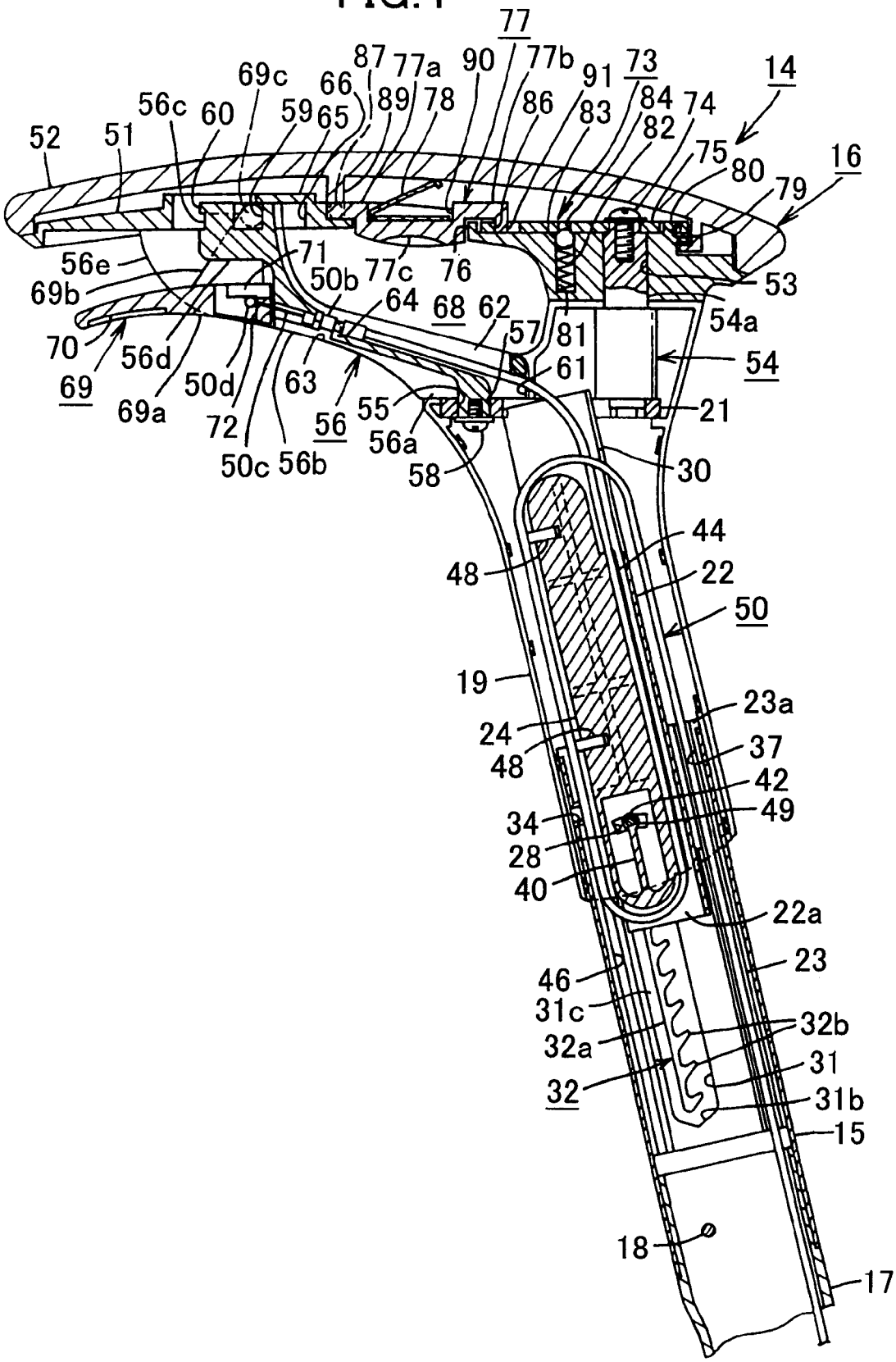
FIG. 4 is a central vertical sectional side view when the armrest is raised to the highest position.

From this position, the whole armrest 14 is pulled up, the pin 49 is engaged and received on the upper-stage engagement portion 32*b* in order, so that the height of the arm pad 16 can be adjusted stepwise by the number of the engagement portion 32*b*. FIG. 4 illustrates an example in which the arm pad 16 is adjusted to the maximum height.

The cable 50 in the arm post 15 is pulled up as well, but is formed as a loop therein and slidably supported in the insertion bore 37. Therefore, the raised height is covered by shortening the loop length thereby avoiding disadvantages of the rising arm pad 16.

When the armrest 14 is pulled up to the upper-limit position, the pin 49 moves forward beyond the end the guide portion 32*c*. In this situation, when the armrest 14 is pressed down, the elastic support portion 40 is elastically deformed forward contrary to the above, and the pin 49 moves downward through a guide path 31*c* between a base portion 32*a* of the stopper member 32 and the front surface of the groove 31 to the lower end of the groove 31, so that the arm pad 16 goes down to the lower-limit position at once.

To prevent the arm pad 16 from going down rapidly and to buffer impact when it stops at the lower-limit-position, the guide path 31*c* between the base portion 32*a* and the groove 31 may have distance such that the pin 49 slides with suitable frictional force.

Using the height-adjusting mechanism 20 as described in the foregoing embodiment, the height of the arm pad 16 can be adjusted stepwise without separate special operating means simply by operation for elevating the whole armrest 14.

The operating lever 69 of the cable 50 is connected to the support arm 56 and elevating therewith, so that the operating lever 69 can be utilized while a person remains comfortably seated thereby improving operation significantly compared with a chair that has an operating lever at the lower part.

To adjust a position of the arm pad 16 in a right-and-left direction, the operating button 77 is pressed up against the leaf spring 78 to disengage the engagement shaft 91 at the rear end from the groove 86 of the position adjusting plate 75. Then, while the operating button is pressed, the arm pad 16 is turned in a right-and-left direction until the ball 83 is put in any one of the bores 84. When a hand is taken off the operating button 66, the engagement shaft 91 is automatically engaged in any one of the recesses 86 thereby adjusting a position of the arm pad 16 stepwise in a right-and-left position depending on the configuration of the seated person. In this situation, to engage the ball 83 and the bore 84 elastically, the arm pad 16 can be turned stepwise appropriately.

The opening 69 through which a hand is inserted is provided under the arm pad 16 and the operating button 77 is provided above the opening 68. By inserting the hand into the opening 68, the position of the operating button 77 can be conveniently reached while still sitting. The arm pad 16 can be grasped with a thumb over the armrest and the other four fingers inserted through the opening 68 thereby turning the operating button 77 and allowing it to be pressed to improve operational capabilities.

The front portion of the arm pad 16 is supported by the support arm 56 which extends forward in the armrest support rod 22 and the rear portion is also supported thereby improving strength against pressing load.

The support arm 56 turns together with the arm pad 16 and a fulcrum of the front portion is not changed. Thus, even if the arm pad 16 is turned in any of the right and left directions, high load strength can be obtained.

Furthermore, the operating lever 69 turns together with the arm pad 16 and the support arm 56 approximately in the same direction as the arm pad 16 right under the front portion of the arm pad 16. Thus, the lever 69 can be easily turned upward by the fingers while the hollow of a hand is put on the front portion of the arm pad 16.

The lever body 69*a* of the operating lever 69 and the arm body 56*b* of the support arm 56 are continuously inclined in an approximately forward position thereby avoiding the cable 50 connected with the operating lever 69 to bend at an acute angle and assuring pushpull wire.

With respect to FIGS. 13 to 20, tilting means "A" for the backrest 7 and the seat 8 as shown in FIG. 1 will be described.

In FIG. 1, between the tubular portion 12*a* and the armrest 14, a seat support rod 92 is integrally provided, and the upper end of the seat support rod 92 is connected to the inner surface of a pair of guide rails 93 via a shaft 94. The guide rails 93,93 are connected to each other by lateral rods 95. The outer surface of the guide rail 93 is connected to the upper end of each of a pair of support links 96,96 via a shaft 97.

Figure 15:
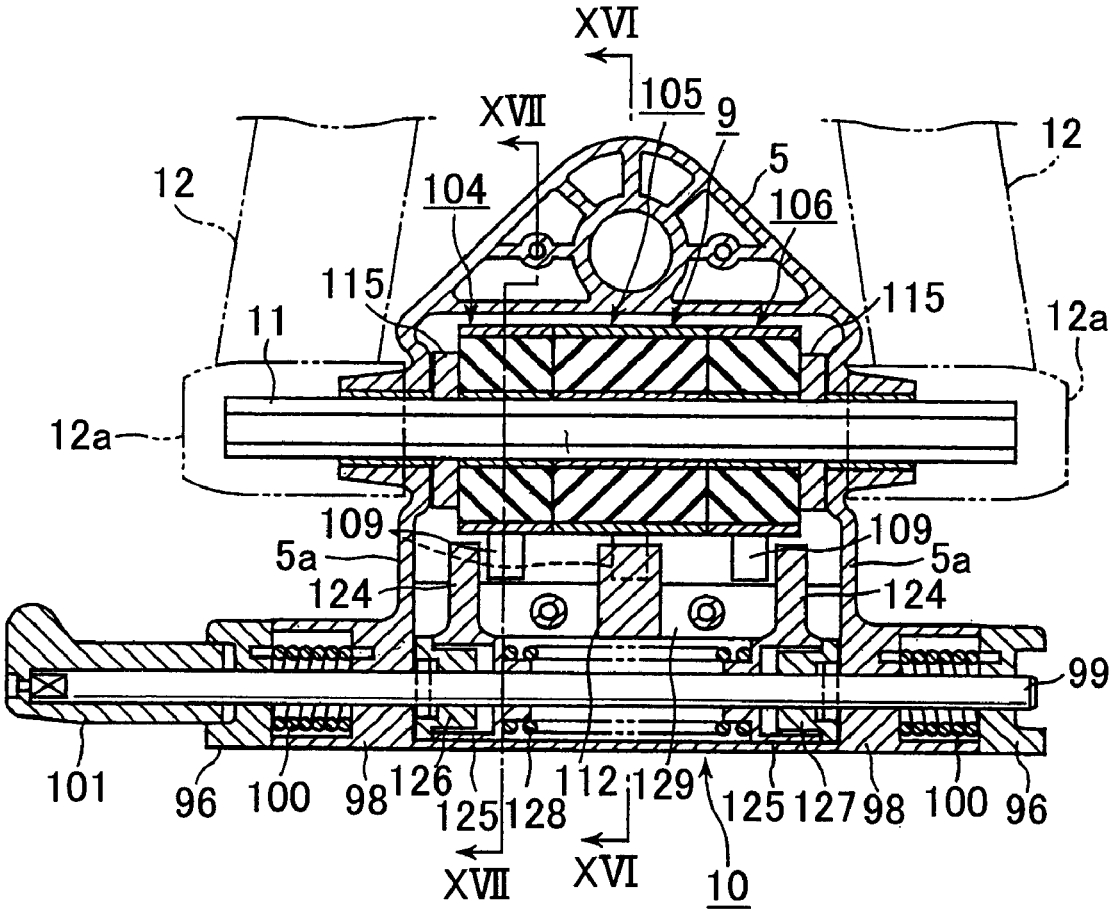
FIG. 15 is a horizontal sectional plan view taken along the line XV-XV in FIG. 2.

The lower portions of the right and left support links 96,96 are rotatably mounted by a horizontal shaft 99 outside tubular portions 98,98 of the side walls 5*a*,5*a* of the base 5, and compelled in a counterclockwise direction in FIG. 2 by a torsion coil spring 100 in each of the tubular portions 98 in FIG. 15. An operating lever 101 for adjusting force promoting return means 9 is fixed to the end of the shaft 99 outside the support link 96.

On the right and left guide rails 93,93, a pair of movable rails 103,103 is mounted to move longitudinally by holding members 102,102 fixed to the seat 8 in FIG. 2. Longitudinal position adjusting mechanism for the seat 8 does not relate to the present invention and description therefore is omitted.

The backrest support rod 12, the seat support rod 92 integrally connected therewith, the support link 96, force promoting return means 9 (described later) and the switching means 10 for promoting force in the base 5 constitute tilting means "A" for tilting the backrest and the seat. By tilting the backrest 7 and the backrest support rods 12,12 rearward and downward around the shaft 11, the backrest support rods 2,12 and the seat support rods 92,92 integrally formed therewith are tilted rearward, so that the rear portion of the seat 8 is moved rearward and downward and the front portion of the seat 8 is moved slightly rearward and downward by tilting the support links 96,96 rearward against the force of the torsion coil springs 100,100. In this embodiment, the torsion coil springs 100,100 are auxiliary to the force promoting return means 9 in the base 5.

Figure 13:
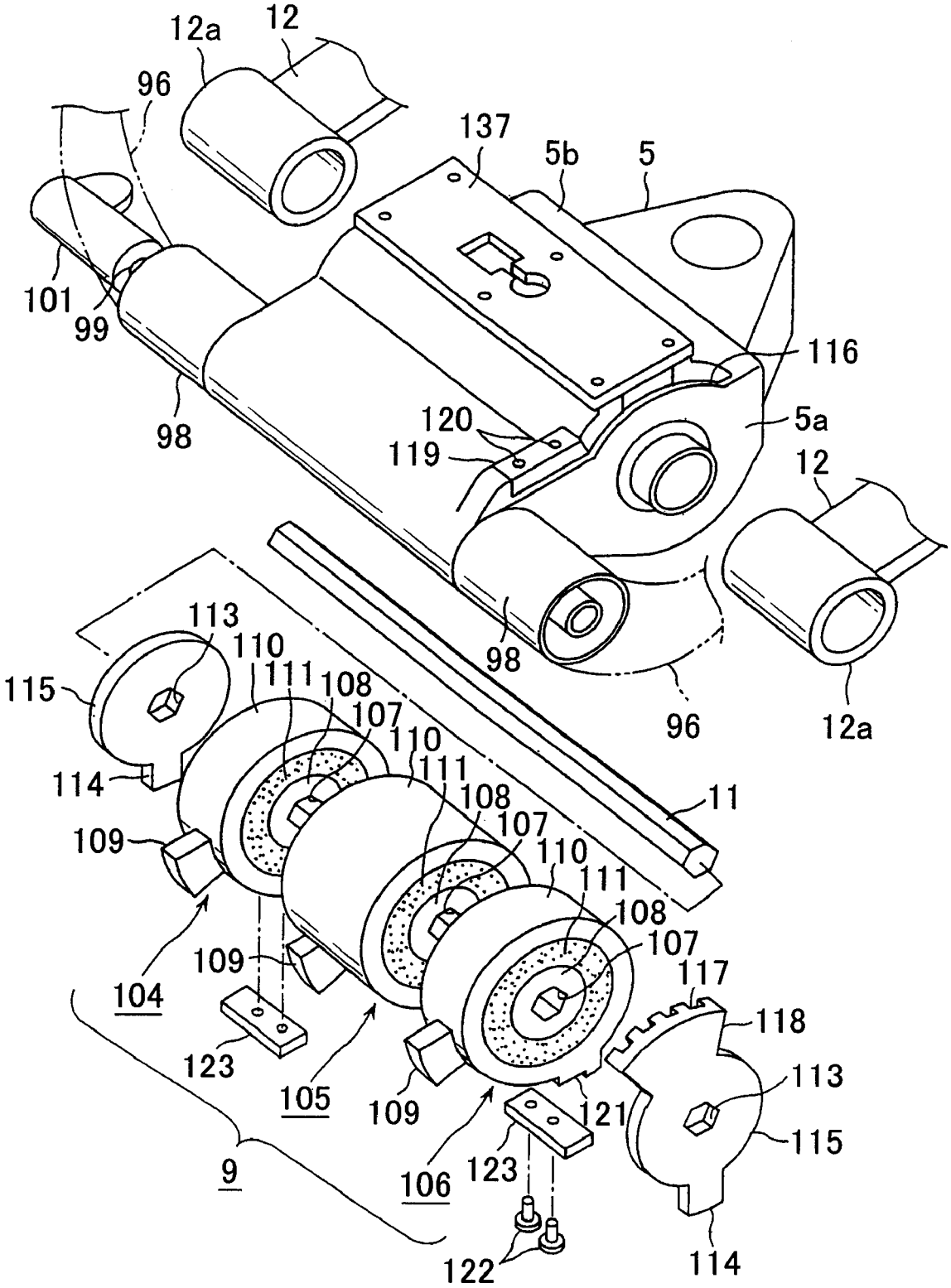
FIG. 13 is an exploded perspective view to show a base and force promoting return means therein.

As shown in FIG. 13, the force promoting return means 9 in the base 5 comprises three force promoting units 104, 105,106, each of which comprises a cylindrical core 108 having a hexagonal bore 108 in which the hexagonal shaft 11 does not turn; an outer tube 110 approximately coaxial with the core 108 and having a projection 109 which contacts the base 5 or the switching means 10 not to turn with respect to the base 5; and a cylindrical elastic material 111 made of rubber or soft synthetic resin between the core 108 and the outer tube 111, the core 108 turning with respect to the outer tube 110 to deform the elastic material 111 elastically to apply returning rotational force to the core.

The middle force promoting unit 105 is larger in axial length than the other force promoting units 104,106 to increase applicable force. The elastic material 111 of the left force promoting unit 104 is different from those of the other force promoting units 105,106 so that the elastic material 111 of the left force promoting unit 104 has higher elastic coefficient than those of the other force promoting units 105,106, thereby making only the necessary amount of applicable force. Therefore, in this embodiment, force promotion gradually becomes larger in order of the left, right and middle force promoting units 104,106,105.

Figure 16:
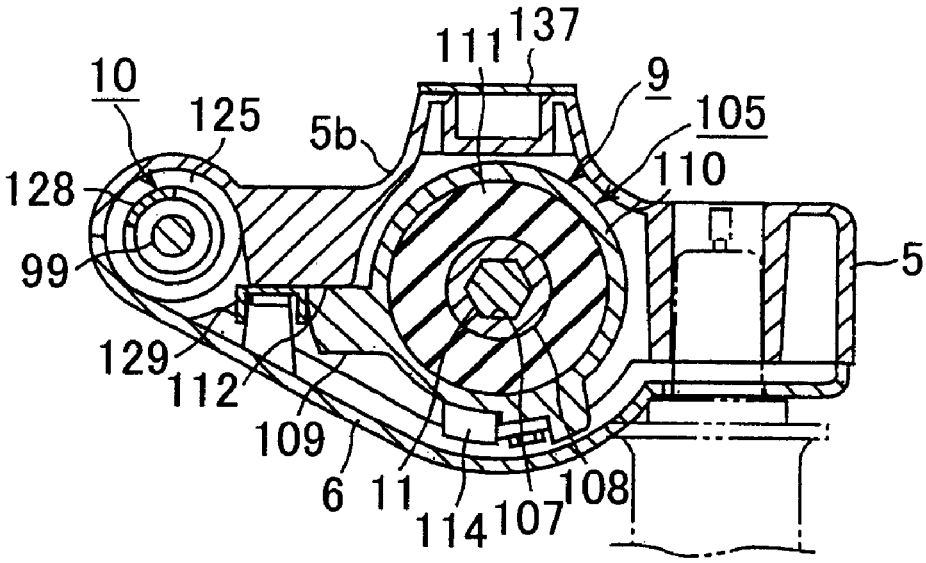
FIG. 16 is a vertical sectional side view taken along the line XVI-XVI in FIG. 15.

In FIG. 16, the projection 109 of the outer tube 110 of the central force promoting unit 105 is always engaged with a stopper portion 112 which suspends from the upper wall 5*b* of the base 5.

Between the outer force promoting units 104,106 and the side walls 5*a*,5*a* of the base 5, a pair of discs 115,115 each of which has a hexagonal bore 113 and a downward projection 114 at the lower portion is disposed so that the hexagonal bore 113 may not turn with the shaft 11. On the upper portion of the right disc 115, there is formed a sector gear 118 which projects through an elongate bore 116 of the upper wall 5*b* of the base 5 and has teeth 117.

When the backrest 7 stops in the maximum stand-up position or initial position, the sector gear 118 provides functions for force promotion or initial returning force of the central force promoting unit 105 to the backrest 7 and for locking the backrest 7 at optional rearward-tilted position.

Specifically, while the sector gear 118 is turned with the shaft 11 by a predetermined initial twisting angle in a counterclockwise direction in FIG. 16 from where the projection 109 of the outer tube 110 of the central force promoting unit 105 is engaged with the stopper portion 112, the front edge of the sector gear 118 is engaged with the rear end of the a stopper plate 119, which is fixed on the upper wall 5*b* of the base 5 by a screw 120. While initial twisting force of the central force promoting unit 105 is applied to the shaft 11, the shaft 11 can be held not to turn in a counterclockwise direction in FIG. 16.

Furthermore, in this situation, initial twisting force by the central force promoting unit 105 can be applied to the backrest 7 in the initial position by fixing the tubular portions 12*a*,12*a* of the backrest support rods 12,12 as initially positioned to both ends of the shaft 11. The function for locking the backrest 7 of the sector gear 118 in an optional downward-tilting position will be described later.

The downward projections 114,114 of the right and left discs 115,115 are engaged with the outward-projecting portion of an engagement plate 123 fixed to a seating portion 121 of the outer tube 110 of the outer force promoting units 104,106 by screws 122,122. The discs 115,115 and the engagement plate 123 are for applying to the outer force promoting units 104,106 an initial twisting force similar to what is applied to the central force promoting unit 105.

Figure 17:
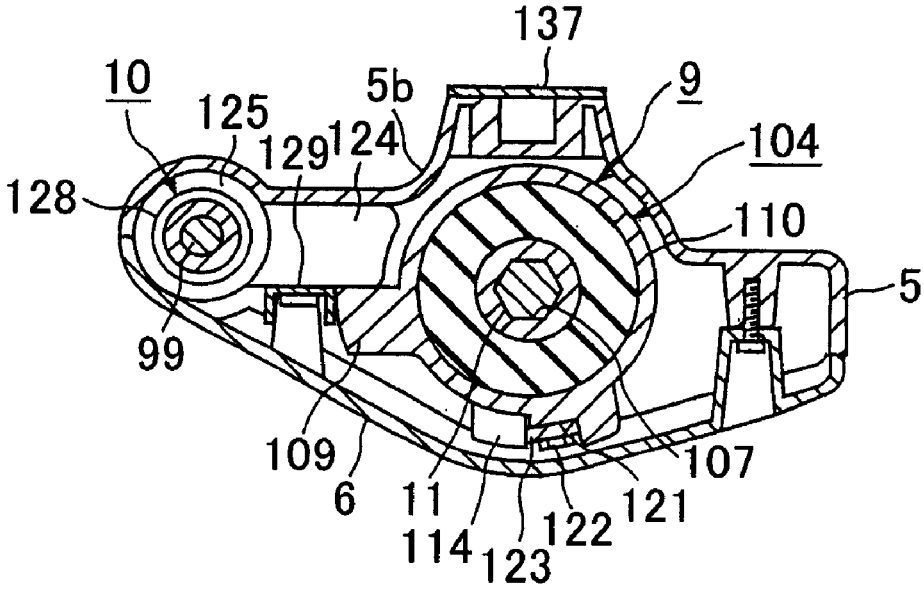
FIG. 17 is a vertical sectional side view taken along the line XVII-XVII in FIG. 15.

That is to say, while the outer tube 110 is turned with respect to the shaft 11 in a counter clockwise direction in FIG. 17 by the same angle as the initial twisting angle for the central force promoting unit 105 in the outer force promoting units 104,106, the engagement plate 123 is fixed to the seating portion 121 of the outer tube 110 by engaging the projection 114 of the disc 115 with the outer portion thereby applying to the outer force promoting units 104,106 an initial twisting force similar to that applied to the central force promoting unit 105.

As mentioned above, in all the force promoting units 104,105,106, by twisting the outer tubes 110 with respect to the shaft 11 by the same initial twisting angle, when the backrest 7 stops at the initial position, the projections 109 of the outer tubes 110 of all the force promoting units 104, 105,106 are arranged at the same position. Therefore, while the projection 109 of the outer tube 110 of the central force promoting unit 105 contacts the stopper portion 112, the projections 109 of the outer tubes 110 of the other force promoting units 104,106 is positioned above the central projection 109 thereby preventing any likelihood of erroneous operation such as inhibiting right-and-left movement of an operating member in the switching means (described later) and achieving suitable operation of the switching means 10.

As shown in FIG. 15, the switching means 10 comprises an operating shaft 99 rotated by the operating lever 101; a pair of operating members 125,125 which is movable between an operative position in which the stopper portion 124 of the operating member 125 is engaged with the projection 109 of the outer tube 110 of the outer force promoting unit 104,106 and an inoperative position in which the stopper portion 124 is disengaged therefrom; a pair of cylindrical cams 126,127 fixed to the shaft 99 to move the operating members 125,125 inwards independently with rotation of the shaft 99; a compression spring 128 around the shaft 99 between the right and left operating members 125,125 to allow the operating members to move away from each other; and a guide bar 129 between the side walls 5*a* and 5*a* of the base 5 to hold the stopper portions 124 of the operating members 125,125 with the upper wall 5*b* of the base 5 to prevent the operating members 125 from rotation and to guide right-and-left movement of each of the operating members 125.

Figure 18:
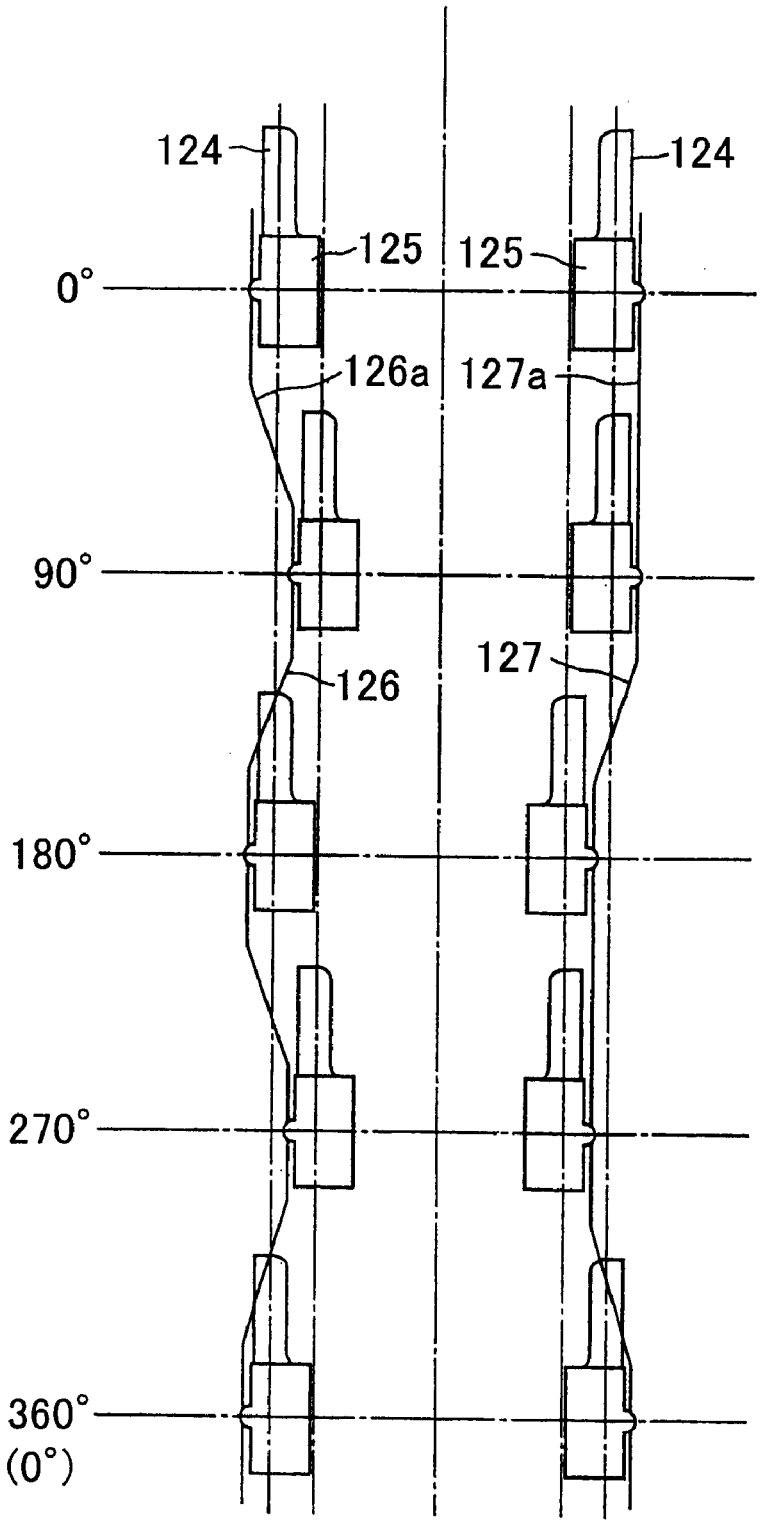
FIG. 18 is a developed view of a cam surface of right and left cylindrical cam in a switching means.

Cam surfaces 126*a*,127*a* of the right-and-left cylindrical cams 126,127 are determined in shape as shown in a development of FIG. 18. When the operating lever 101 is kept at a predetermined 0° position, the right-and-left operating members 125,125 are both in inoperative positions. When the operating lever 101 is turned to the position of 90° position from the situation, only the left operating member 125 is pressed rightward against exerting force on the compression spring 126 and kept in an operating position, while the right operating member 125 is still kept in an inoperative position. When the operating lever 101 is further turned to the 180° position, the right-and-left operating members 125,125 are both moved leftward, so that the left operating member 125 is kept in an inoperative position and the right operating member 125 is kept in an operating position. Furthermore, when the operating lever 101 is turned to the 270° position, only the left operating member 125 is pressed rightward and right-and-left operating members 125,125 are kept in an operative position.

While the operating lever 101 is turned from the 270° position to the 360° position or the 0° position, the right and left operating members 125,125 move away from each other and are kept in an inoperative position. Thus, when the operating lever 101 is turned 0° position to 270° position, force promotion for returning the backrest 7 becomes larger stepwise, which is the minimum or only force promotion of the central force promoting unit 105 at 0°; weak or the sum of the promoting force of the central force promoting unit 105 and the promoting force of the left force promoting unit 104 at 90°; strong or the sum of the urging force of the central force promoting unit 105 and the urging force of the right force promoting unit 106; and the maximum or the total sum of the promoting force of all the force promoting units 104,105,106.

In the meantime, while the operating lever 101 is turned from the 0° position to the 270° position, the distance between the left and right operating members 125,125 becomes gradually smaller stepwise, and operation resistant force of the operating lever 101 by the compression spring 128 gradually becomes larger stepwise. With one touch the operation resistance force of the operating lever 101 becomes larger allowing for the recognition that the returning force of the backrest is increasing.

Figure 14:
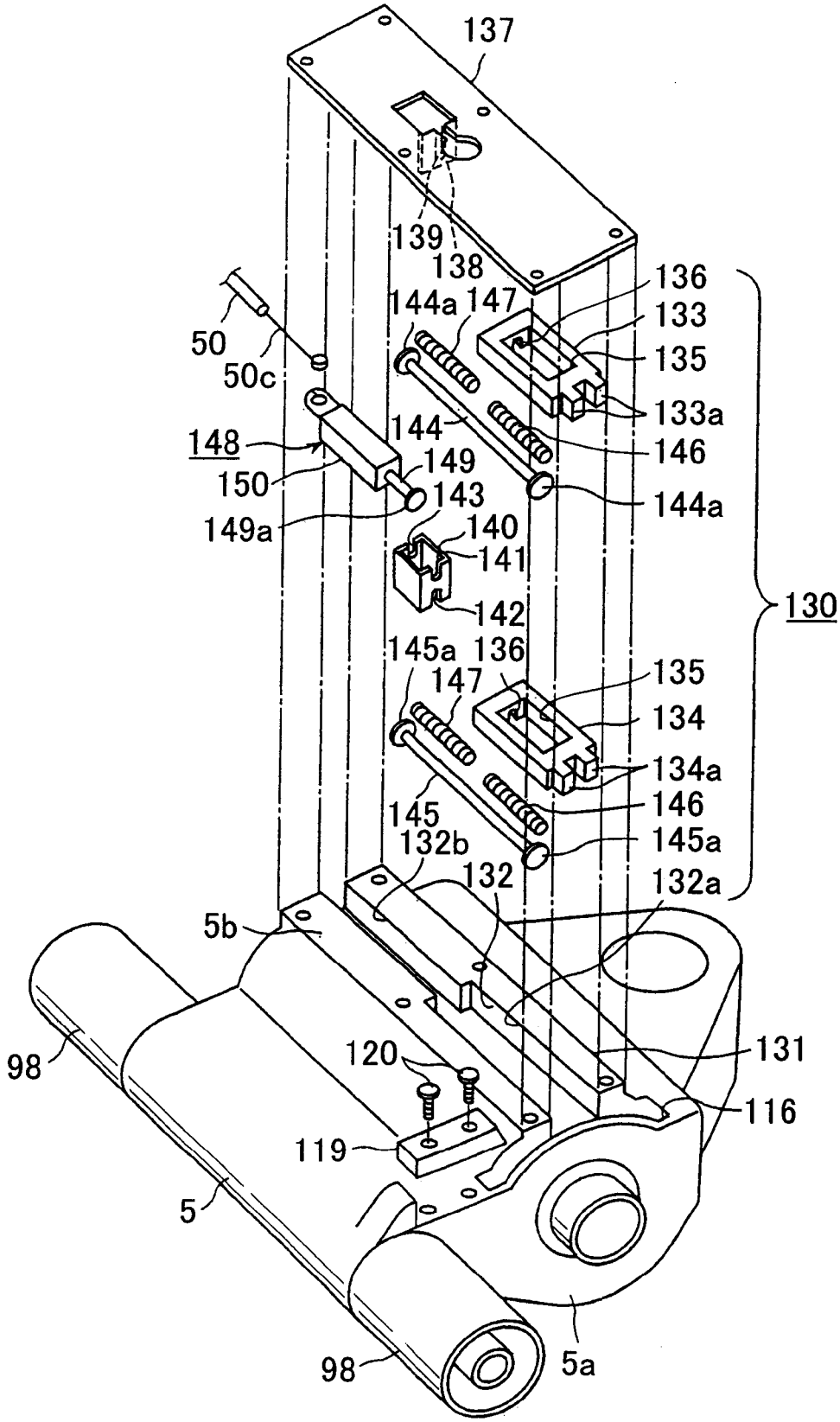
FIG. 14 is an exploded perspective view to show the base and locking means thereon.

As shown in FIG. 14, there is a casing 131 for receiving locking means 130 for locking the backrest 7 at a desired rearward tilting angle on the upper wall 5*b* of the base 5. In the casing 131, there is a receiving groove 132 which comprises a right larger-width portion 132*a* and a left smaller-width portion 132*b*. In the larger-width portion 132*a*, there are provided two engagement members 133,134 respectively having teeth 133*a*,134*a* which are engaged with the teeth 117 of the sector gear 118 at the same pitch angle. The engagement member 133 is put on the engagement member 134 and they are together slidable. The teeth 133*a*,134*a* of the upper and lower engagement members 133,134 are formed with difference in phase by half a pitch from each other, so that any one of them is engaged with the teeth 117 of the sector gear 118.

In each of the engagement members 134,135, a rectangular opening 135 is formed, and a U-shaped groove 136 which communicates with the rectangular opening 135 is formed at the lower end of the left side wall. The upper surface of the casing 131 is covered with a cover plate 137. A partition plate 138 is formed downward from the middle of the cover plate 137 and engaged with the right end of the smaller-width portion 132*b*. The partition plate 138 has a U-shaped groove 139 from the upper end. A rectangular connector 140 is slidably engaged on the partition plate 139 of the smaller-width portion 132*b*. On the right side wall of the connector 140, upper and lower U-shaped grooves 141,142 are formed symmetrical with each other vertically, and a U-shaped groove 143 is formed on the left side wall.

A pair of rods 14 having flanges 144*a*,145*a* respectively is slidably put through the U-shaped grooves 136,136 of the upper and lower engagement members 133,134, the U-shaped groove of the partition plate 138 and the upper and lower U-shaped grooves 141,142 of the connector 140.

Between outer flanges 144*a*,145*a* of the upper and lower rods 144,145 and the left end face of the rectangular bore 135 of the upper and lower engagement members 133,134, compression springs 146,146 which surround each of the rods 144,145 are provided and between the left end faces of the upper and lower engagement members 133,134 and the right side face of the partition plate 138, compression springs 147,147 which surround each of the rods 144,145 are provided.

Force exertion of the compression springs 146 may be determined to be approximately equal to or slightly larger than that of the compression spring 147.

In the U-shaped groove 143 of the connector 140, an outer flange 149*a* of a shaft 149 of a pull-lock/pull-release mechanism 148 is engaged. In the pull-lock/pull-release mechanism 148, the shaft 149 passes through a rectangular case 150 in the narrower portion 132*b*. The shaft 149 is pulled from a casing 150 leftward and engaged by a known rotary reciprocation engagement mechanism similar to a push-type ball-point pen in the casing 150 in a left-pulled application. Then, the shaft 149 is pulled leftward again, and the engagement of the rotary reciprocation engagement mechanism is released, so that the shaft 149 is moved rightward. Thereafter, whenever the shaft 149 is pulled leftward, the rotary reciprocation engagement mechanism fluctuates between engagement and disengagement. A stroke of the shaft is longer than a distance required for any one of the teeth 133*a*,134*a* of the two engagement members 133,134 to engage with the teeth 117 of the sector gear 118.

The left end of the shaft 149 is connected to the end of the wire 50*c* which projects from the lower end of the cable 50 the upper end of which is connected to the operating lever 69 of the armrest 14, so that the shaft 149 is pulled leftward whenever the operating lever 69 turns upward.

To install the locking means 130 to the base 5, after the engagement members 133,134, the connector 140, the rods 144,145, the compression springs 146,147 and the pull-lock/pull-release mechanism 148 are all inverted and connected to the inverted cover plate 137 in order, they may be inserted in the groove 132 of the casing 131 while inverted together.

Figure 19:
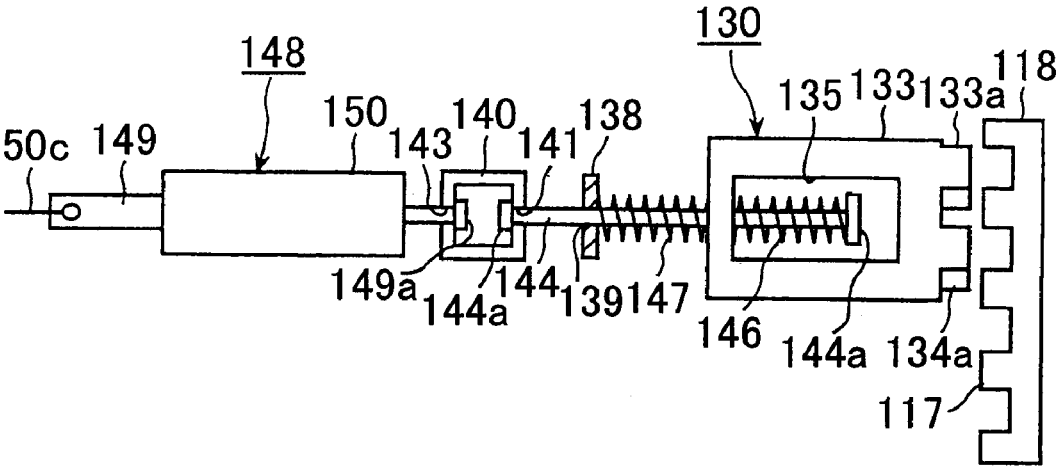
FIG. 19 is a top plan view which shows lock-release condition of locking means.
Figure 20:
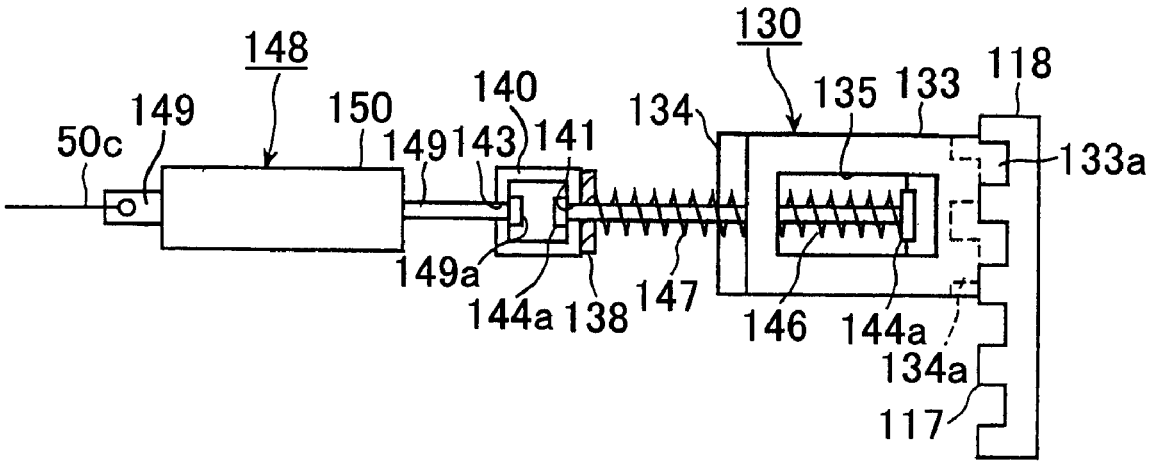
FIG. 20 is a top plan view which shows locking of the locking means.

As shown in FIG. 19, when the shaft 149 is pulled leftward and locked, the connector 140 is moved leftward by the outer flange 149*a* and the upper and lower rods 144,145 are moved leftward. Usually owing to the balance of forces in the compression springs 146,147, the upper and lower engagement members 133,134 stop in an inoperative position where the teeth 133*a*,134*a* are disengaged from the teeth 117 of the sector gear 118. In this situation, the backrest 7 is always inclined toward a standing position by promoting force adjusted by the operating lever 101 and can be tilted rearward with a suitable resistant force by pressing it rearward against the promoting force.

In this situation, after the backrest 7 is tilted rearward to a desired angle, the operating lever 69 of the armrest 14 is turned upward and the shaft 149 is moved leftward once to facilitate release of the pull-lock/pull-release mechanism 148. As shown by a solid line in FIG. 20, the shaft 149 is moved rightward, so that the connector 140, the upper and lower rods 144,145 and the upper and lower engagement members 133,134 are moved rightward by the balance of force in the compression springs 146,147 allowing any one of the teeth 133*a*,134*a* of the upper and lower engagement members 133,134 to engage with the teeth 117 of the sector gear 118. If such engagement does not occur, the backrest 7 is slightly tilted in a back-and-forth direction thereby allowing any one of the teeth 133*a*,134*a* to engage with the teeth 117 of the sector gear 118.

After any one of the teeth 133*a*,134*a* (133*a* in FIG. 20) is engaged with the teeth 117 of the sector gear 118, the backrest 7 is locked into this position. Even if the back of a sitting person is moved away from the backrest 7, the backrest 7 is never moved from the position to the back-and-forth direction.

When the operating lever 69 is turned upward again from the position where the backrest 7 is locked, the shaft 149 is moved leftward once and the pull-lock/pull-release mechanism 148 is locked, so that the shaft 149 is locked while moved leftward. Thus, any one of the engagement members 133,134 which is disengaged from the upper and lower rods 144,145 and the teeth 117 of the sector gear 118 is moved leftward. In this example, the lower engagement member 134 is moved leftward.

However, the engagement member 133 which is engaged with the teeth 117 of the sector gear 118 receives large exerting force in an approximately right-angled direction not to move away from the sector gear 118 suddenly. Only when the sitting person is resting against the backrest 7 to put load on the engagement members 133,134 against the above force, the engagement members 133,134 are disengaged from the sector gear 118 and moved leftward owing to the balance of forces in the compression springs 146,147. For this purpose, the upper and lower engagement members 133,134 are not joined to the upper and lower rods 144,145 but allowed play by the compression springs 146,147.

As described the above, in this embodiment, forth promotion for returning the backrest 7 can be adjusted stepwise over a wide range by turning the operating lever 101, and the backrest 78 is locked or unlocked at a desired angle by the operating lever 69.

In this embodiment, the backrest and the seat are supported on the base to enable rearward-and-downward inclination together and urged forward-and upward by the force promoting return means, but the present invention may be applied to a chair in which any one of a backrest and a seat is supported to enable rearward-and downward inclination.

The force promoting units may be two or more than three, or all promoting forces can be selected and transmitted to a backrest or a seat.

Three or more engagement members 133,134 may be provided, in which phases of the teeth 133*a*,134*a* are shifted by ⅓ or one divided by the number of the engagement member to each other, adjustable pitch can be further decreased.

Figure 21:
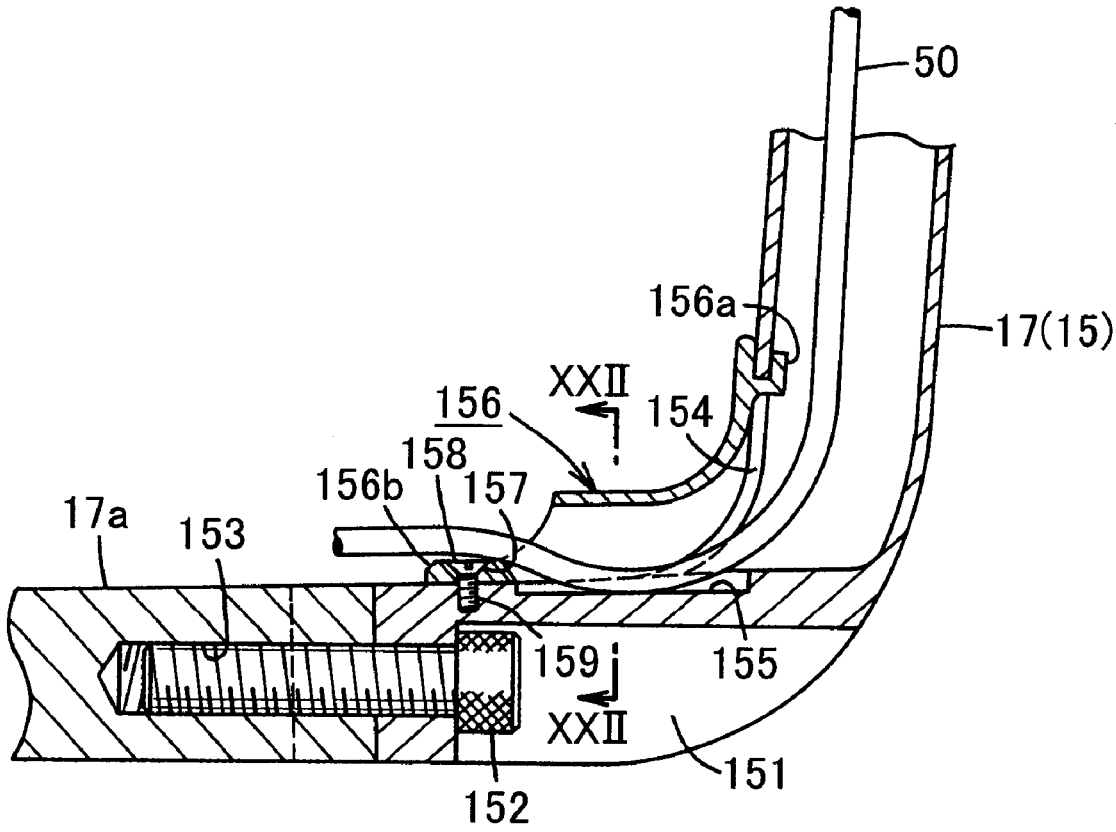
FIG. 21 is a vertical sectional front view of a cable exit at the lower end of an arm post.
Figure 22:
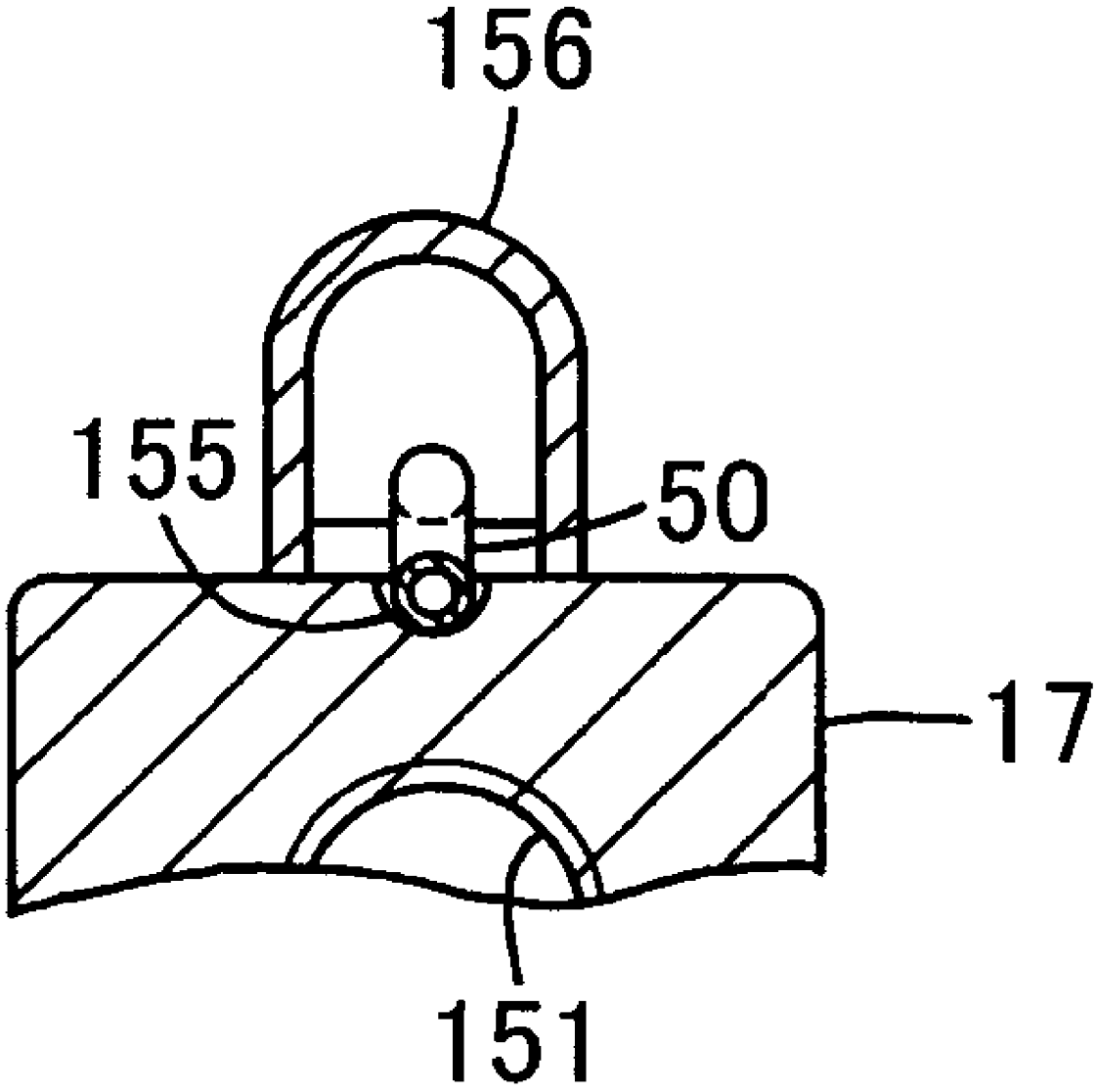
FIG. 22 is a vertical sectional side view taken along the line XXII-XXII in FIG. 21.
Figure 23:
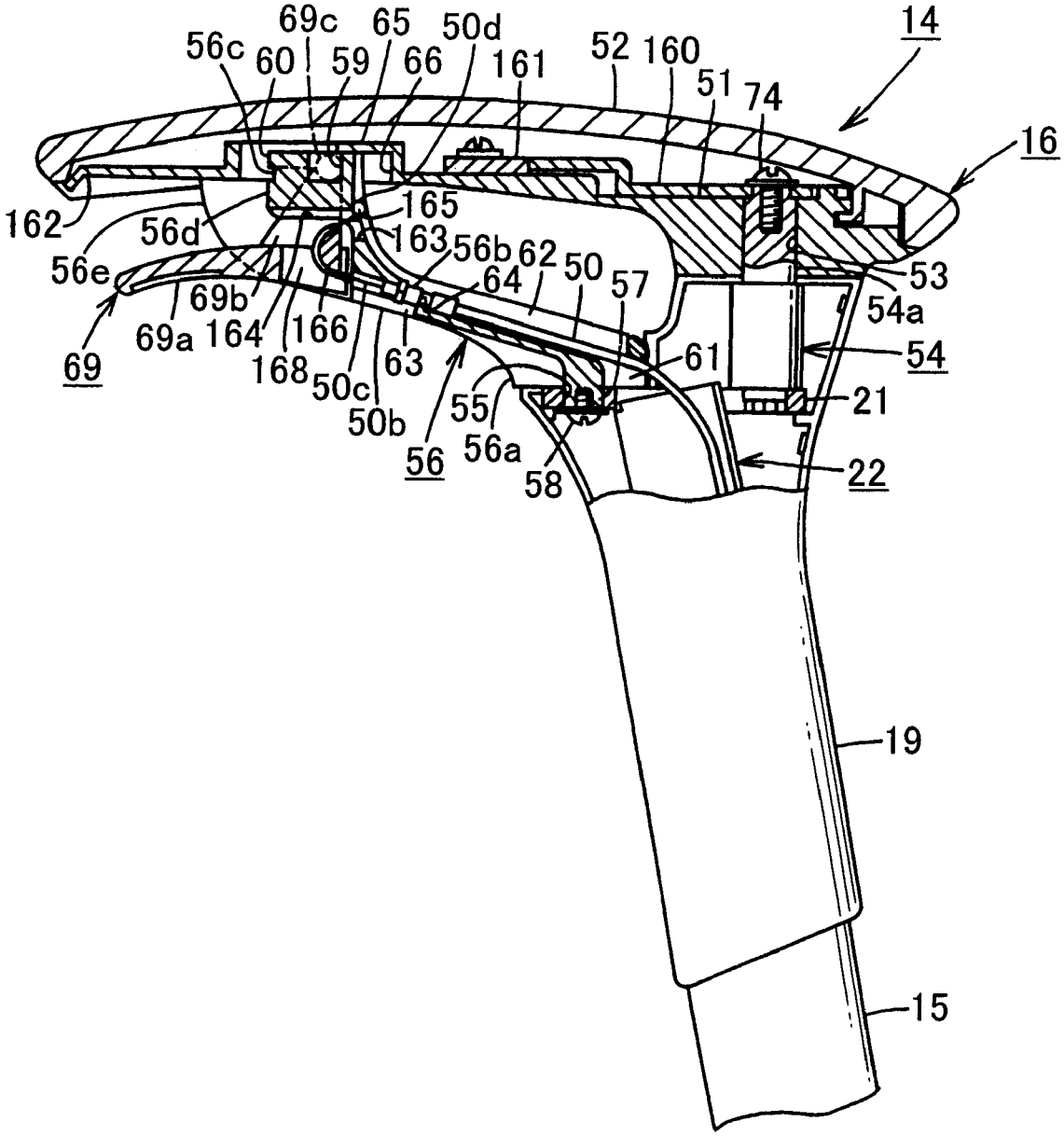
FIG. 23 is a partially cut-out side view which shows a variant of an armrest.

FIGS. 21 and 22 show an exit of the cable 50 at the lower end of the armrest 14. At the side end of the armrest mounting rod 17*a* which extends from the middle of the backrest support rod 12, the L-shaped connecting rod 17 is fastened by allowing a bolt 152 inserted through an opening 151 to mesh with a female bore 153 of the armrest mounting rod 17*a*.

The cable 50 in the arm post 15 is taken out of an exit 154 of the connecting rod 17 toward the seat 8 and connected to the shaft 149 of the tilting means "A" at the lower end. A recess 155 is formed on the upper surface of the connecting rod 17 to communicate with an exit 154 and has a part of the cable 50 therein. At an inner bending portion of the connecting rod 17, a synthetic cover 156 which can cover the exit 154 and the recess 155 is provided.

The cover 156 is bent to cover a bending portion of the connecting rod 17 and has an inverted U-shape as shown in FIG. 22.

As shown in FIG. 21, an engagement portion 156*a* is provided at the upper end of the cover 156 and engaged in the exit 154 of the connecting rod 17. A mounting piece 156*b* which has a thread bore 157 is formed at the lower end of the cover 156.

To secure the cover 156 to the arm post 15, the engagement portion 156*a* is engaged in the exit 154 while the cable 50 is taken out of the cover 156. Thereafter, the mounting piece 156*b* is fixed to the arm post 15 by engaging a lead screw 158 into a thread bore 159 through a screw-insertion bore 157.

The cover 156 over the cable 50 is cosmetically pleasing by allowing the exit 154 to be covered with the cover 156. The lower end of the cable 50 is put in the recess 155 in the cover 156, so that the cable 50 loosened in the arm post 15 is kept stable in the cover 156 without moving in a depth direction when the armrest 14 is adjusted in height.

In this embodiment, the cable 50 is partially covered with the cover 156. However, the cable 50 may be covered over a wider range by expanding the size of the cover. The cover 156 may be mounted at the upper end to the arm post 15 by a screw.

FIGS. 23 to 27 show a variation of a connecting portion of an operating lever 69 and a cable 50 in an armrest 14 and a horizontal position adjusting mechanism of an arm pad 16.

A slidable stopper plate 160 is disposed on an armrest base plate 51, and the rear portion of the stopper plate 160 is fixed to a smaller-diameter shaft 54*a* of a support shaft 54 by a screw 74.

Numeral 161 denotes a position-adjusting plate movable in a depth direction on the armrest base plate 51 in the front of the stopper plate 160, and has a rear end face which has a plurality of engagement grooves (not shown) engagable with the front end of the stopper plate 160 selectively. The position adjusting plate 161 and the stopper plate 160 constitute horizontal position adjusting means for the arm pad 16.

A concave portion 162 is formed on the lower surface of the front portion of the armrest base plate 51.

Under an auxiliary arm 56*d* in the front of an arm body 56*b* of a support arm 56, there is formed a through bore 163 in which an engagement ball 50*d* at the end of a wire 50*c* is inserted. Under the auxiliary arm 56*d*, a slit 164 in which the end of the wire 50*c* is inserted is formed to communicate with the through bore 163.

To engage with and keep the engagement ball 50*d* of the wire 50*c*, an arc-sectioned step 165 is formed on the rear surface of the auxiliary arm 56*d* of the arm body 56*b* to partially communicate with the slit 164.

Figure 26:
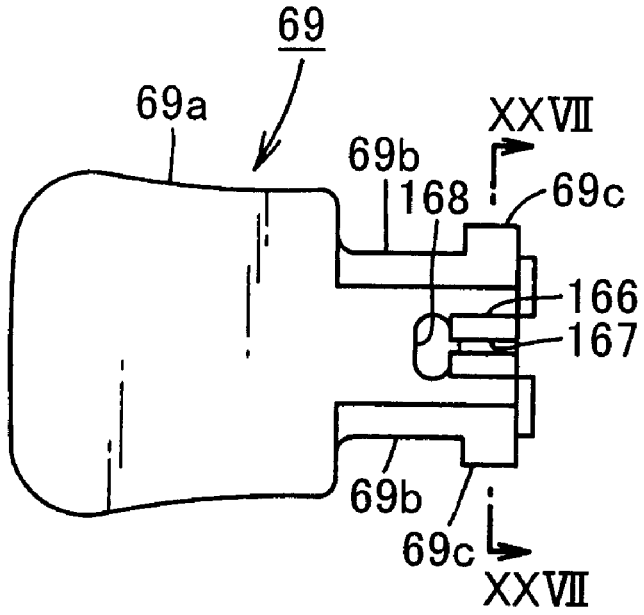
FIG. 26 is a top plan view of an operating lever.
Figure 27:
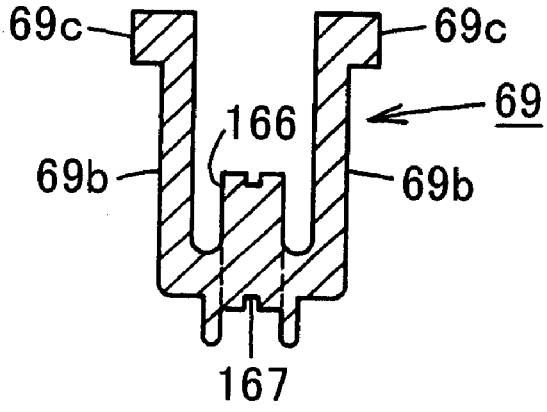
FIG. 27 is a vertical sectional front view taken along the line XXVII-XXVII in FIG. 26.

In FIGS. 26 and 27, between support portions 69*b* and 69*b* of a lever body 69*a* of the operating lever 69, a semicircle-sectioned wire holder 166 projects from the rear end of the operating lever 69 and has a recess 167 in which the wire 50 is slidably engaged. In front of the wire holder 166, a through bore 168 in which the wire 50*c* is inserted is formed in the lever body 69*a*.

To mount the upper end of the cable 50 to the operating lever 69, the wire 50*c* is allowed to pass through the through bore 168 and to wind in the recess 167 of the wire holder 166 of the operating lever 69. Then, the engagement ball 50*d* is engaged on the step 165 through the through bore 163 of the support arm 56.

Figure 24:
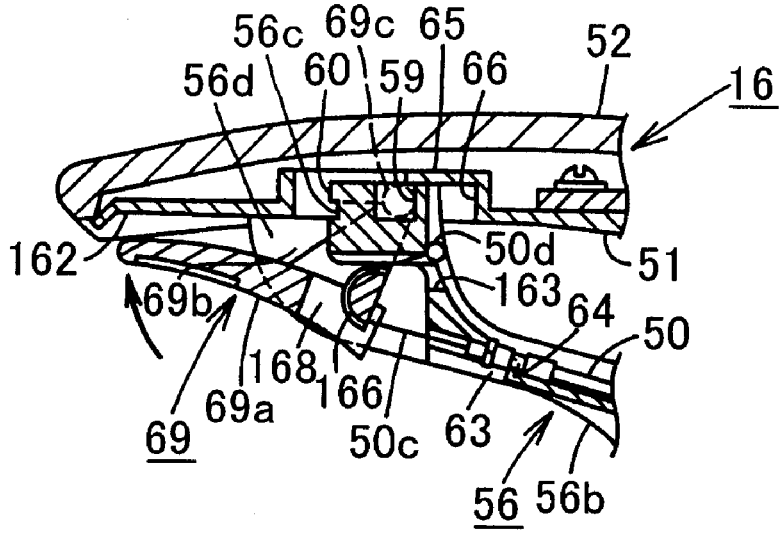
FIG. 24 is a vertical sectional side view when an operating lever is moved upward.
Figure 25:
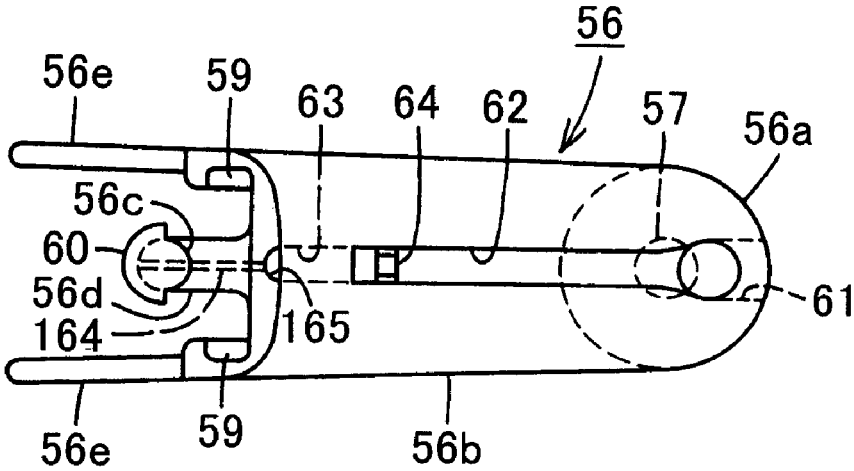
FIG. 25 is a top plan view of a support arm.

When the operating lever 69 is turned upward while fixing the end of the wire 50*c*, the wire 50*c* is pulled twice as long as forward movement of the wire holder 166 as shown in FIG. 24. The operating lever 69 can be turned until the front end of the lever 69 is engaged on the lower surface of the concave portion 162 of the armrest base plate 51.

The foregoing merely relates to embodiments of the invention. Various changes and modifications may be made by a person skilled in the art without departing from the scope of claims.

What is claimed is:

1. An armrest device in a chair, comprising:

an arm post extending vertically;

an arm pad provided at a top of the arm post and having an elongate bore in a front lower surface;

an armrest support plate extending horizontally in the arm post and having a support bore in a front part;

a support arm extending between the lower surface of the arm pad and the armrest support plate, an axial portion at a front end of the support arm being placed in the elongate bore of the arm pad and slidable longitudinally of the arm pad, a support shaft at a rear end of the support arm being put in the support bore of the armrest support plate and being horizontally pivotal; and a vertical shaft mounted to a rear part of the armrest support plate at a lower end supporting the arm pad at an upper end, enabling the arm pad to pivot horizontally.

* * * * *